US007455431B2

(12) United States Patent
Brower et al.

(10) Patent No.: US 7,455,431 B2
(45) Date of Patent: Nov. 25, 2008

(54) HIGH EFFICIENCY LIGHT FIXTURE

(76) Inventors: Richard Brower, 3 Gordon Dr., Rockland, ME (US) 04841; Brian Huppi, 101 28th St., Apt. 5, San Francisco, CA (US) 94131

( * ) Notice: Subject to any disclaimer, the term of this patent is extended or adjusted under 35 U.S.C. 154(b) by 334 days.

(21) Appl. No.: 11/373,400

(22) Filed: Mar. 9, 2006

(65) Prior Publication Data

US 2006/0203493 A1 Sep. 14, 2006

Related U.S. Application Data

(60) Provisional application No. 60/661,081, filed on Mar. 11, 2005.

(51) Int. Cl.
*G09F 13/04* (2006.01)

(52) U.S. Cl. ..... 362/297; 362/341

(58) Field of Classification Search ..... 362/296–298, 362/341, 346, 260

See application file for complete search history.

(56) References Cited

U.S. PATENT DOCUMENTS

| | | | |
|---|---|---|---|
| 2,341,658 | A | 2/1944 | Selani |
| 3,124,310 | A | 3/1964 | Lipscomb |
| 3,529,148 | A | 9/1970 | Stefano |
| 3,829,677 | A | 8/1974 | DeLlano |
| 4,006,355 | A | 2/1977 | Shemitz et al. |
| 4,034,217 | A | 7/1977 | Dumont |
| 4,218,727 | A | 8/1980 | Shemitz et al. |
| 4,293,901 | A | 10/1981 | Hernandez |
| 4,344,111 | A | 8/1982 | Ruud et al. |
| 4,422,134 | A | 12/1983 | Brass |
| 4,499,529 | A | 2/1985 | Figueroa et al. |
| 4,531,180 | A | 7/1985 | Hernandez |
| 4,549,249 | A | 10/1985 | Shemitz |
| 4,562,517 | A | 12/1985 | Pankin |
| 4,683,525 | A | 7/1987 | Camm |
| 4,719,546 | A | 1/1988 | Spitz |
| 4,729,075 | A | 3/1988 | Brass |
| 4,751,626 | A | 6/1988 | Plewman |
| 4,779,178 | A | 10/1988 | Spitz |
| 4,796,168 | A | 1/1989 | Peterson |
| 4,814,954 | A | 3/1989 | Spitz |
| 4,816,976 | A | 3/1989 | Fouke et al. |
| 4,974,138 | A | 11/1990 | Negishi |
| 4,991,072 | A | 2/1991 | Malifaud |
| 5,062,030 | A | 10/1991 | Figueroa |

(Continued)

OTHER PUBLICATIONS

International Search Report dated Oct. 30, 2006 from corresponding International Application PCT/US06/08979.

*Primary Examiner*—Ali Alavi
(74) *Attorney, Agent, or Firm*—Beyer Law Group LLP

(57) ABSTRACT

A light fixture for illuminating a specific target area is disclosed. The light fixture includes an extended light source that emits light from a surface. The light source emits light from the surface in directions towards the target area and away from the target area. The light fixture also includes a reflector arrangement configured to redirect the light that would otherwise be emitted from the surface of the light source in directions away from the target area to directions towards the target area such that substantially all the light emitted from the light source is made incident in or directed into the target area.

45 Claims, 36 Drawing Sheets

U.S. PATENT DOCUMENTS

| | | | |
|---|---|---|---|
| 5,192,129 | A | 3/1993 | Figueroa et al. |
| 5,335,152 | A | 8/1994 | Winston |
| 5,394,317 | A | 2/1995 | Grenga et al. |
| 5,678,922 | A | 10/1997 | Robertson |
| 5,690,422 | A | 11/1997 | Brass |
| 5,788,366 | A | 8/1998 | Rabl et al. |
| 5,816,693 | A | 10/1998 | Winston et al. |
| 5,918,969 | A | 7/1999 | Chu et al. |
| 6,220,729 | B1 * | 4/2001 | Holten ..... 362/291 |
| 6,257,735 | B1 | 7/2001 | Baar |
| 6,271,532 | B1 | 8/2001 | Trokhan et al. |
| 6,443,598 | B1 | 9/2002 | Morgan |

* cited by examiner

HIGH EFFICIENCY LIGHT FIXTURE

CROSS REFERENCE TO RELATED APPLICATIONS

This application claims priority benefit of U.S. Provisional Patent Application No.: 60/661,081, filed Mar. 11, 2005, entitled "HIGH EFFICIENCY LIGHT FIXTURE," which is hereby incorporated herein by reference.

BACKGROUND OF THE INVENTION

1. Field of the Invention

The present invention relates generally to a light fixture. More particularly, the present invention relates to a light fixture for directing substantially all light generated therefrom within a specific target area.

2. Description of the Related Art

The fluorescent light tube is more than 60 years old, and has become, by far, the dominant source for commercial light fixtures in stores, factories, offices . . . etc. Yet their inherent high efficiency has been wasted all these years by placing them in an inefficient luminaire, usually no more than a curved white rear 'reflector' or a white box with some form of lens. No innovative designs appeared until the late 60's with the need to reduce glare in offices, by placing reflective grids in front of the tubes to direct some of the stray light in a more downward direction. But the combined thickness of many reflector elements obstructing the output aperture, further reduced efficiency.

Next came light absorbing baffles in front of the tube to minimize stray light, but they restricted the direct downward light as well, and therefore, also reduced efficiency.

With the advent of computers in offices during the 80's, however, some effort ensued to develop a better luminaire. But the designs were hampered by three misunderstandings: (1) the belief that a luminaire must be shallow to follow current architectural and lighting concepts, (2) a lack of recognizing the difference between the behavior of output rays from a 'point source' (the hot filament inside a clear flashlight bulb), and a 'distributed source' (the glowing outer surface of the fluorescent tube itself), and (3), little interest in developing a technique for calculating or measuring the actual light output over a target area, an essential to guide the design efforts.

SUMMARY OF THE INVENTION

The invention relates, in one embodiment, to a light fixture for illuminating a specific target area. The light fixture includes an extended light source that emits light from a surface. The light source emitting light from the surface in directions towards the target area and away from the target area. The light fixture also includes a reflector arrangement configured to redirect the light that would otherwise be emitted from the surface of the light source in directions away from the target area to directions towards the target area such that substantially all the light emitted from the light source is made incident in or directed into the target area.

The invention relates, in another embodiment, to a method of designing a high efficiency light fixture. The method includes determining the desired target area where light is to be distributed. The method also includes selecting a light source capable of illuminating the desired target area. The method additionally includes configuring an outer reflector to reflect all light incident thereon to the desired target area. The outer reflector partially surrounds the light source and defines an open end where both light emitted from the light source and light reflected from the outer reflector travels out of the light fixture. The outer reflector captures a majority of stray light that would otherwise travel through the open end of the outer reflector in a direction outside the target area and redirects it to the target area. The method further includes configuring an inner reflector to reflect all light incident thereon to the desired target area while still substantially allowing direct light emitted from the light source in a direction towards the target area and light reflected from the outer reflector to reach the target area. The inner reflector is positioned at the open end of the outer reflector. The inner reflector captures the remaining portions of stray light that would otherwise travel through the open end of the outer reflector in a direction outside the target area and redirects it to the target area.

The invention relates, in another embodiment, to a method of illuminating a specific target area. The method includes emitting light from the surface of a light source, with the light emanating in directions towards the target area and away from the target area. The method also includes reflecting at least a first portion of the light emanating in directions away from the target area to the target area, with the entire first portion of light being made incident within the target area. The method further includes reflecting at least a second portion of the light emanating in direction away from the target area to the target area, with the entire second portion of light being made incident within the target area. As a result, substantially all the light emitted from the light source is directed into the target area due to the reflections.

The invention relates, in another embodiment, to a light fixture. The light fixture includes a lamp that emits light from a surface. The light fixture also includes a reflector arrangement that uniformly concentrates all the light emitted from the surface of the lamp to a target area. The reflector arrangement includes an outer reflector partially surrounding the lamp and defining an open end through which light emitted from the surface of the lamp and light reflected from the outer reflector travel out of the light fixture. The outer reflector includes a plurality of interconnected outer facets positioned in an arcuate manner such that the outer reflector flares outwardly from its center to its open end. Each of the outer facets has a flat mirrored surface that faces the lamp and that reflects all light incident thereon to the target area. The reflector arrangement also includes an inner reflector positioned at the open end of the outer reflector. The inner reflector captures stray light that is traveling in a direction away from the target area and redirects the stray light to the target area. The inner reflector includes a plurality of spaced apart and laterally positioned inner facets, each of the inner facets having flat mirrored surfaces on both of its sides that reflect all light incident thereon to the target area. In some cases, the light fixture may further include one or more partitions for helping support the inner facets and possibly helping direct some of the light towards the target area.

BRIEF DESCRIPTION OF THE DRAWINGS

The invention may best be understood by reference to the following description taken in conjunction with the accompanying drawings in which.

DETAILED DESCRIPTION OF THE INVENTION

The present invention pertains to a high efficiency light fixture. One aspect of the invention relates to methods and apparatuses for directing a much greater percentage than attainable with prior art of the light generated therefrom within a specific target area. For example, the light fixture may include one or more reflectors for redirecting any light traveling away from the target area (e.g., stray light) back to the target area. In one embodiment, the light fixture includes an outer reflector for redirecting a first portion of the stray light to the target area and an inner reflector for redirecting the remaining portions of the stray light to the target area. In another embodiment, the light fixture includes one or more partitions for redirecting light end to end of the light fixture. Another aspect of the invention relates to methods and apparatuses for controlling the intensity and location of the light inside the specific target area. That is, the light made incident in the target area can be controlled in a manner so as to produce a more uniform distribution of illumination across the target area (e.g., center to edge uniformity). By way of example, the outer and inner reflectors as well as the partitions may include mirrored facets having characteristics that can be adjusted to produce the desired output within the target area.

Embodiments of the invention are discussed below with reference to FIGS. 1 to 36. However, those skilled in the art will readily appreciate that the detailed description given herein with respect to these figures is for explanatory purposes as the invention extends beyond these limited embodiments.

Figure 1:
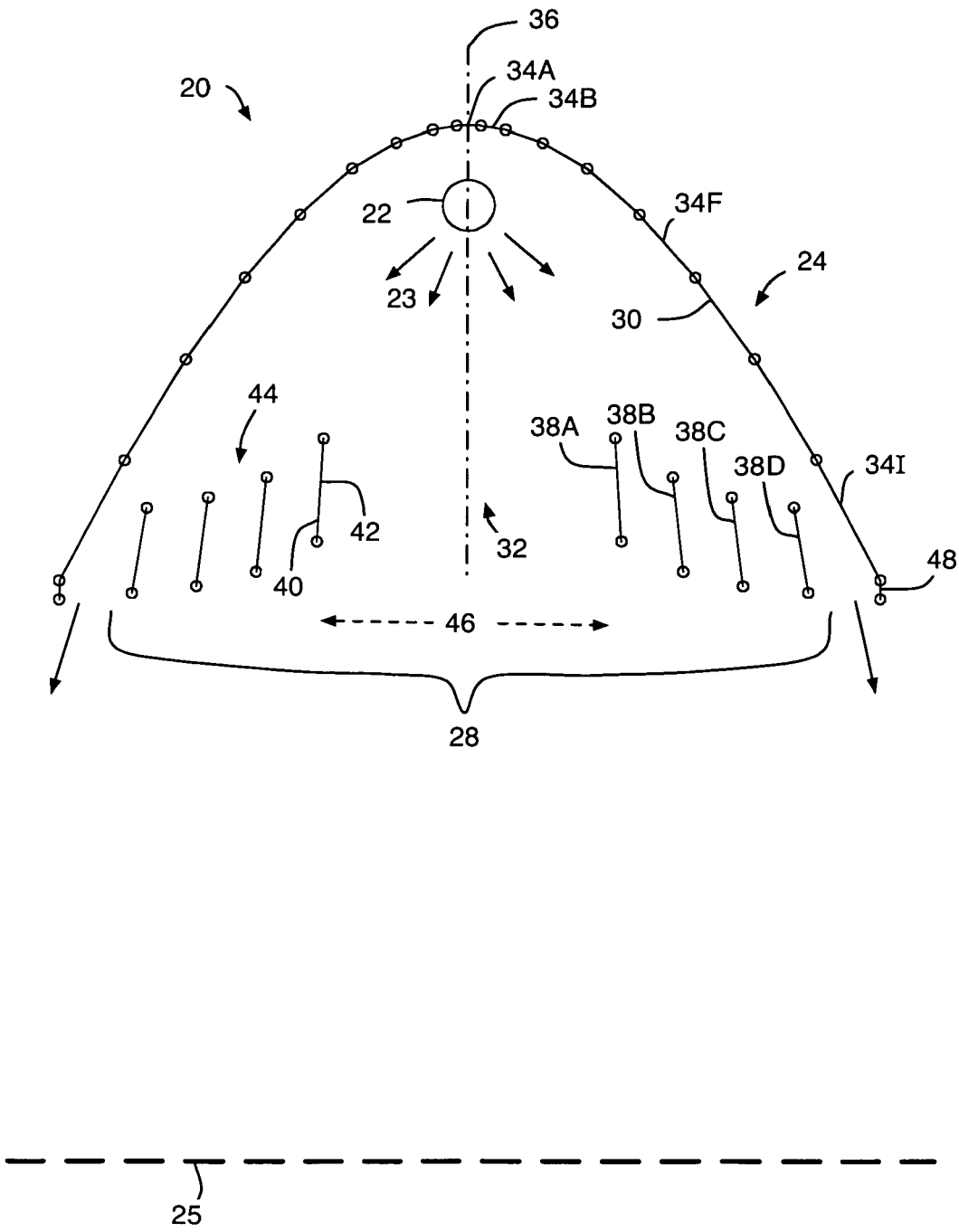
FIG. 1 is the end view, in cross section, of a light fixture, in accordance with one embodiment of the present invention.

FIG. 1 is an end view, in cross section, of a light fixture 20, in accordance with one embodiment of the present invention. The light fixture 20 is configured to concentrate the energy output of the light fixture to a specific target area 25. The target area 25 may for example correspond to a specific area of a building, room, or work surface. In the case of an open box building, the light fixture may be used to illuminate a specific area of the building as for example aisles in a store. In the case of a room, the light fixture may be used to illuminate a specific area of the room as for example a cubicle or assembly area. In the case of a work surface, the light fixture may be used to illuminate a table top.

The light fixture 20 includes a lamp or light source 22 capable of emitting light 23 so as to illuminate the target area 25. The lamp 22 is preferably an extended source such that light is emitted in all directions from each point on its surface. The lamp 22 may be widely varied and may correspond to any known light source. The lamp may, for example, be selected from incandescent, fluorescent or halogen bulbs or tubes. Alternatively, the lamp 22 may be embodiment as one or more light emitting diodes, or neon light devices.

Although a single lamp is shown, it should be appreciated that the lamp may be embodied as one or more light sources. For example, rows of fluorescent tubes, a matrix of incandescent light bulbs, or an array of light sources such as LEDs.

The light fixture 20 also includes a reflector arrangement 24 configured to concentrate the light being emitted from the lamp 22 to the specific target area 25, and further, to distribute the light in a controlled manner across the target area 25. The reflector arrangement 24 redirects light that would otherwise normally stray away from the target area 25. That is, the reflector arrangement 24 helps keep a majority of the light emitted from the lamp 22 inside the target area 25. As should be appreciated, without the reflector arrangement 24, some of the emitted light would be incident on the target area 25 while much of the emitted light would not (thereby creating inefficiencies).

The reflector arrangement 24 captures much of the emitted light that is not incident on the target area and redirects it to the target area 25. The target area 25 is therefore illuminated by both direct light from the lamp 22 and redirected light from the reflector arrangement 24. This combination produces a light output that would not be possible with the lamp 22 alone, i.e., the light output is dramatically increased. Furthermore, the reflector arrangement 24 can be configured to distribute light in different quantities to specific areas of the target area 25 so as to effect the intensity of the light across the target area 25 in a controlled manner. For example, the reflector arrangement 24 can be configured to produce stronger illumination regions or weaker illumination regions depending on the needs of the application. In most cases, the reflector arrangement 24 is configured such that the illumination provided by the light fixture 20 is made substantially equal across the target area 25. However, this is not a limitation. In some cases, the reflector arrangement 24 may be designed to produce a non uniform light output with light intensities that vary across the target area 25.

In one embodiment, the reflector arrangement 24 is configured to redirect substantially all the stray light (light traveling outside the target area) into the target area 25 thereby ensuring that a major portion of the light generated at the lamp 22 is placed inside the target area 25. This drastically increases the efficiency of the light fixture 20, and in the case illustrated below, increases the efficiency by more than a factor of 7. Alternatively, the reflector arrangement 24 can be designed to place only a portion of the stray light into the target area 25. This however would lower the efficiency of the light fixture. The design generally depends on the desired output of the light fixture 20.

As shown, the light fixture 20 includes an outer reflector 24 having an inner reflective surface 30 (e.g., mirrored. The outer reflector 24 partially surrounds or drapes around the lamp 22 and includes an open end 32 where light passes when exiting the light fixture 20. Although not formed from a continuous curve, the outer reflector 24 typically has an arcuate shape that flares outwardly around the lamp 22. The outer reflector 24 is configured to capture the portion of the light that is emitted towards the outer reflector and redirect it in a direction towards the open end 32 of the outer reflector 24, and more particularly in a direction towards the target area 25. In one embodiment, substantially all light made incident on the outer reflector 24 is reflected in a direction towards the target area 25. As such, a majority of the light emitted from the lamp 22 is directed towards the target area 25 thereby increasing the efficiency of the light fixture 20. Furthermore, the outer reflector 24 may be configured to redirect the light using a single reflection. That is, the light only reflects off the inner reflective surface 30 once before heading to the target area 25.

In cases where the lamp 22 is an elongated light tube such as a fluorescent light tube, the reflective surface 30 of the outer reflector 24 typically surrounds or wraps around opposing sides of the light tube (as shown). In cases where the lamp 22 is a light bulb such as an incandescent light bulb, the reflective surface 30 of the outer reflector 24 may be configured to partially surround or wrap around the bulb similar to the light tube or alternatively it may wrap around all sides of the bulb (e.g., dome or bowl).

The outer reflector 24 includes a plurality of angled outer facets 34B-34I located on both sides of the outer reflector and positioned in an arcuate manner such that the outer reflector 24 flares outwardly from its center to its open end. The outer reflector 24 may also include a central horizontal facet 34A located at the center of the outer reflector 24 (directly above the lamp). Alternatively, the central horizontal facet 34A may be removed such that the angled facets start right at the centerline rather than from the edge of a central horizontal facet 34A. Each of the outer facets 34 include a straight flat mirrored surface 30 that faces the lamp 22 and that reflects all light incident thereon to the target area 25. The outer facets 34 may be formed from a single integral member or from a plurality of individual interconnected members (as shown). In either case, the outer reflector includes apex points (indicated by dots) between each of the outer facet segments.

The number, length and angle of the angled outer facets 34 are determined in such a way so as to selectively direct all the light reflected therefrom within the target area 25. This is generally accomplished while keeping the depth of the light fixture 20 as low as possible (e.g., low profile).

In the illustrated embodiment, each side of the outer reflector 24 includes eight angled outer facets 34B to 34I that flare outwardly from the center to the open end of the outer reflector 24. The angled outer facets become steeper from the innermost facet 34B to the outermost facet 34I, at the outer edge of the reflector 24. That is, the angle of each individual angled outer facet 34 relative to the horizontal becomes steeper from the center to open end of the outer reflector 24. Furthermore, the length of the outer facets 34 may become longer from the innermost facet 34B to the outer edge of the outer reflector 24. That is, each consecutive outer facet 34 grows larger than the previous outer facet 34 when going from the center to the edge of the outer reflector 24.

In most cases, the outer reflector 24 is configured symmetrically about a vertical axis 36 which passes through the center of the light fixture 20, i.e., a mirrored image on both sides of its vertical axis 36. It should be noted, however, that this is not a limitation and that in some cases it may be desirable to use an asymmetric outer reflector in order to produce the desired output.

The reflector arrangement 24 also includes an inner reflector 28 which is positioned proximate the open end 32 or mouth of the outer reflector 24, and more particularly inside the outer reflector 24. The inner reflector 28 is configured to capture any remaining stray light that emanates from the lamp 22 (and/or possibly the outer reflector 24) and that would otherwise travel through the open end 32 of the outer reflector 24 in a direction outside the target area 25, and redirects the stray light to the target area 25, while still substantially allowing direct light emitted from the lamp 22 to continue in a direction towards the target area 25, and light reflected from the outer reflector 24 to reach the target area 25 (either directly or indirectly through one or more reflections). By way of example, the inner reflector 28 may redirect light that is emitted from the lamp 22 that would otherwise travel past the edge of the outer reflector to an area outside the target area 25. In one embodiment, substantially all light made incident on the inner reflector 28 is reflected in a direction towards the target area 25. As such, substantially all light emitted from the lamp 22 is directed towards the target area 25 thereby further increasing the efficiency of the light fixture 20.

To elaborate, the inner reflector 28 includes a plurality of spaced apart and laterally positioned inner facets 38A to D on both sides of the vertical axis. The inner facets 38A to D are typically angled and located between the center and edge of the open end 32 of the outer reflector 24. Each of the inner facets 38 has straight flat mirrored surfaces on both of its sides 40 and 42 that reflect all light incident thereon to the target area 25.

The number, length, angle and space between each of the angled inner facets 38A to D are determined in such a way so as to prevent stray light from leaking past the edge of the outer reflector 24 and to redirect the stray light within the target area 25. This is generally accomplished while still allowing direct light from the lamp 22 and reflected light from the outer reflector 24 to pass through (e.g., minimal attenuation). For example, the gaps 44 located between the laterally spaced inner facets allow a major portion of the aforementioned light to pass through. Furthermore, the innermost facets 38A (ones located closest to the vertical axis) generally form a space 46 for allowing light to travel directly from the lamp 22 to the target area 25 (e.g., center to edge).

In the illustrated embodiment, the inner reflector 28 includes four angled inner facets 38A to D on each side of the vertical axis 36. The angled inner facets become steeper from the edge facet 38D to the innermost facet 38A. That is, the angle of each individual angled inner facet relative to the horizontal becomes steeper from the edge of the outer reflector 24 to the vertical axis 36 of the light fixture 20. Furthermore, the inner facets may be vertically offset relative to one another. For example, the position of the inner facets 38A to D may consecutively step up from the edge facet 38D to the innermost facet 38A.

In most cases, the inner reflector 28 is configured symmetrically about the vertical axis 36 which passes through the center of the light fixture 20, i.e., a mirrored image on both sides of its vertical axis 36. It should be noted, however, that this is not a limitation and that in some cases it may be desirable to use an asymmetric inner reflector in order to produce the desired output.

In some cases, the outer reflector 24 may include a stop facet 48 at its bottom edge that blocks the light leakage that can occur over the inner reflector 28.

The configuration including angle, number and dimensions of the outer and inner facets may be widely varied. The configuration generally depends on many factors including but not limited to the overall depth of the light fixture, the desired light output, the lamp, the desired target area, the height of the light fixture relative to the target area and/or the like. All of these variables are taken into account when designing the light fixture 20.

Figure 2:
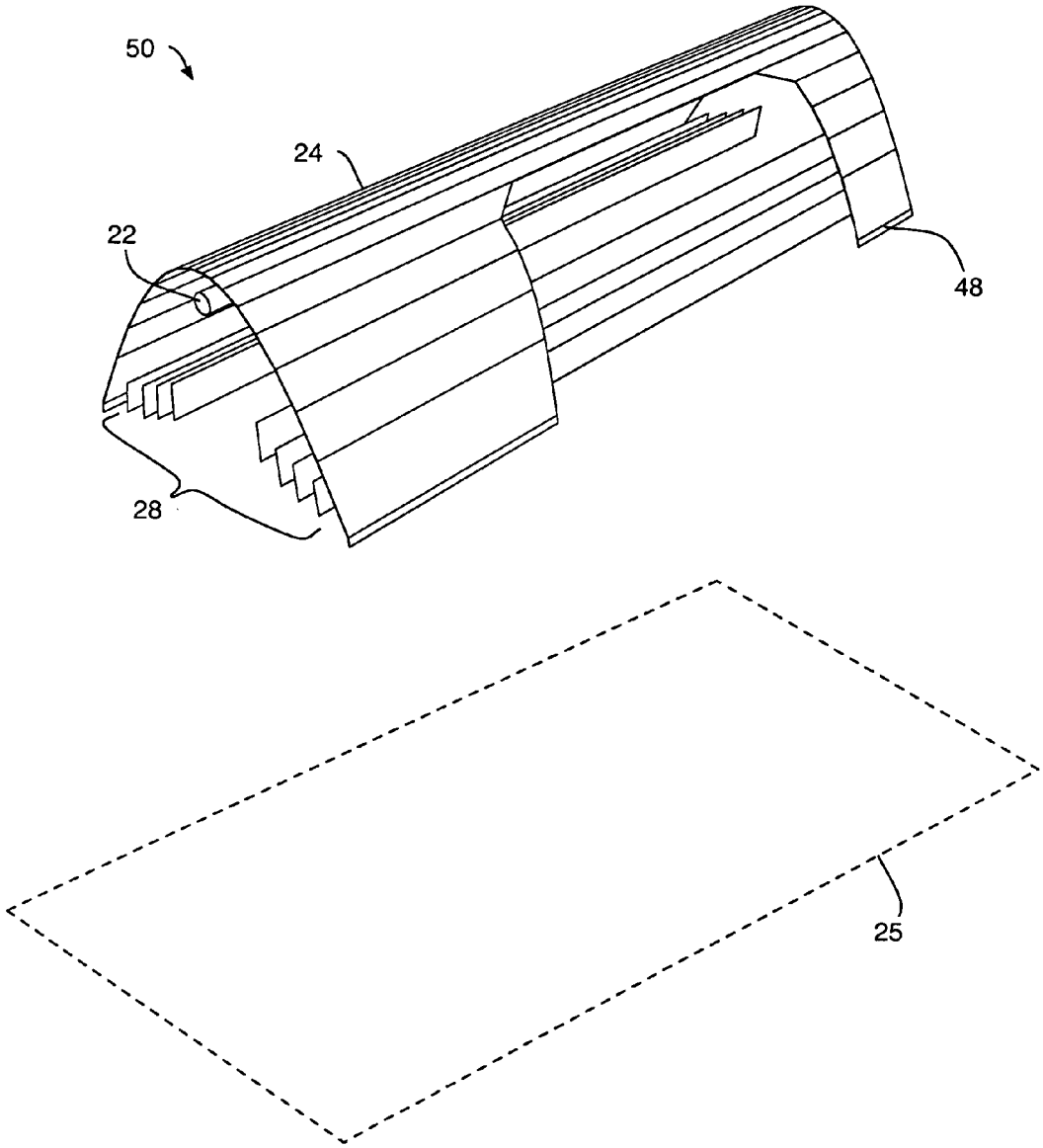
FIG. 2 is an isometric cut away view of a high efficiency light fixture, in accordance with one embodiment of the present invention.

FIG. 2 is an isometric cut away view of a high efficiency light fixture 50, in accordance with one embodiment of the present invention. The light fixture 50 may generally correspond to the light fixture shown and described in FIG. 1. In this embodiment, both the lamp 22 and reflector arrangement 24 extend longitudinally in parallel from one end to an opposite end. The lamp 22 may for example be a fluorescent tube that emits light radially outwardly in all directions from the surface area between the ends of the lamp 22. As such, all the surfaces of the reflector arrangement 24 including the outer and inner reflectors 24 and 28 extend the length of the lamp 22 so that the light being emitted therefrom can be redirected in the manner described above. This particular arrangement typically produces a rectangular shaped target area 25.

Figure 3:
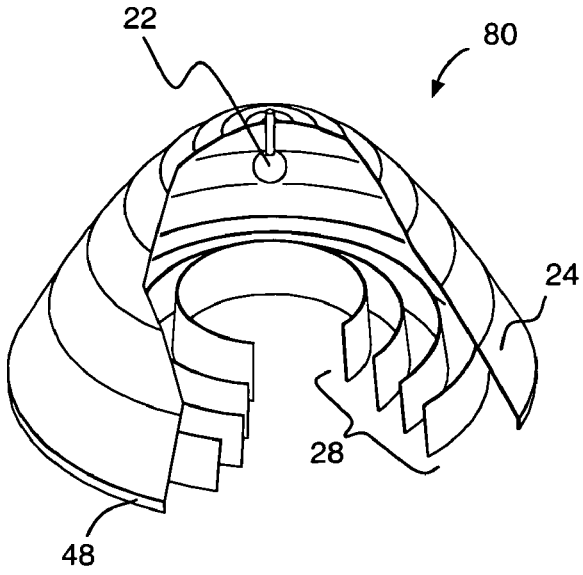
FIG. 3 is an isometric cut away view of a high efficiency light fixture, in accordance with another embodiment of the present invention.
Figure 3:
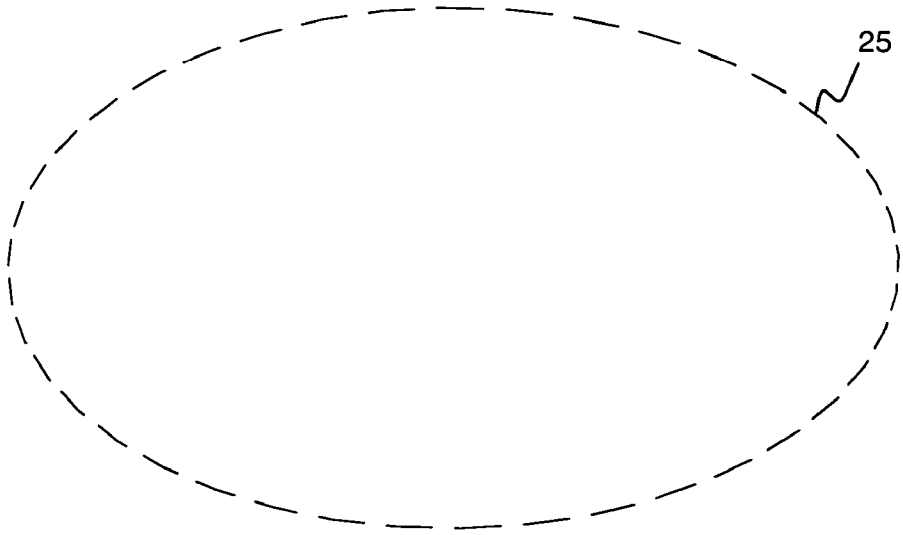

FIG. 3 is an isometric cut away view of a high efficiency light fixture 80, in accordance with another embodiment of the present invention. The light fixture 80 may generally correspond to the light fixture shown and described in FIG. 1. In this embodiment, the lamp 22 is in the form of a bulb rather than a tube and the reflector arrangement 24 is in the shape of a dome or bowl. The lamp 22 may for example be an incandescent or fluorescent light bulb that emits light radially outwardly in all directions from the bulb (except at the region that connects to the light outlet contained in the central facet). As such, the reflector arrangement 80 including the outer and inner reflectors 24 and 28 encircle the light bulb so that the light being emitted therefrom can be redirected in the manner described above. This particular arrangement typically produces a circle shaped target area 25.

It should be noted that symmetric dome and bowl shapes (e.g., hemisphere) are not a limitation and that other shapes may be used. The shape generally follows the illumination output from the lamp. For example, in the case of a pill shaped light, the outer and inner reflectors may also be pill shaped.

An example of the design process and the function of the light fixture 20 in FIG. 1 will now be described in conjunction with FIGS. 4-24.

Figure 4:
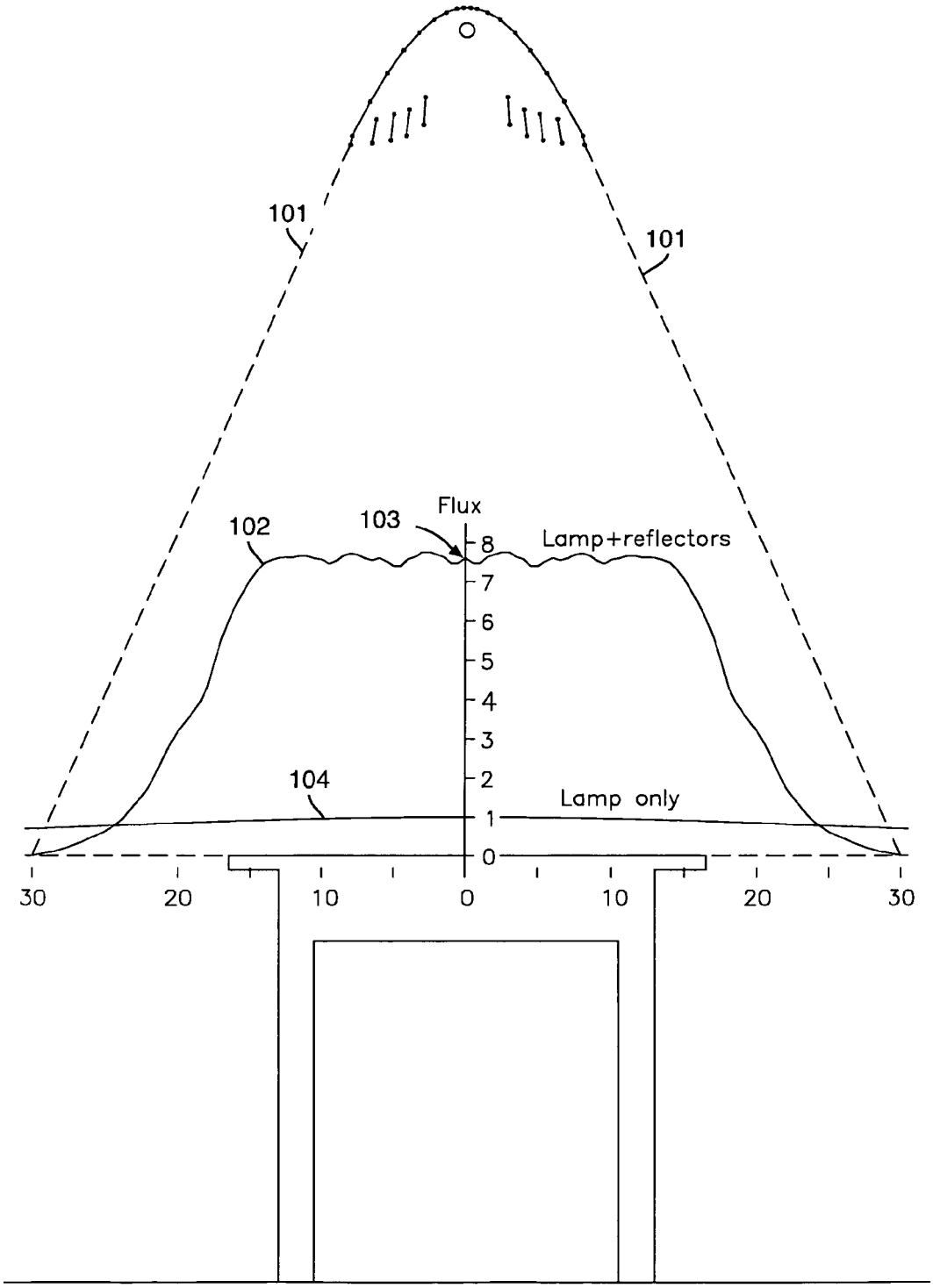
FIG. 4 is an illustration showing the light fixture illuminating a work surface and a comparison of the lamp output with and without the reflectors, in accordance with one embodiment of the present invention.

FIG. 4 depicts the light fixture 20 illuminating a typical work surface, shown here as a simple table. The dashed lines 101 indicate the range of light output from the light fixture 20. For the purpose of this discussion we will define "zero" as the point on the work surface that intersects the center axis of the lamp (e.g., fluorescent tube) and the outer reflector. In this particular illustration, the target area is 60 inches wide and the design goal is to provide a maximum and uniform amount of illumination on the work surface plane with a rapid attenuation to zero illumination at ±30 inches from the table centerline (at zero). The advantage of limiting the extreme rays in this fashion is the reduction of glare to the user as well as elimination of light on adjacent work surfaces, computer stations, etc. The maximum output of the fluorescent tube alone 104 is shown on the vertical scale 103 at 1 for reference. The profile of the light fixture 20 output is given by the curve 102. As shown, it has a relatively flat and uniform response across the entire table surface. Furthermore, the magnitude of the light fixture output 102 is more than seven times that of the fluorescent tube alone 104, and the direct lamp output at ±30 inches has been reduced to zero.

Since the invention is directed at extended sources, understanding the difference between a point source and an extended source is important to the discussion of the invention. The description that follows provides a comparison between point sources and extended sources.

Figure 5A:
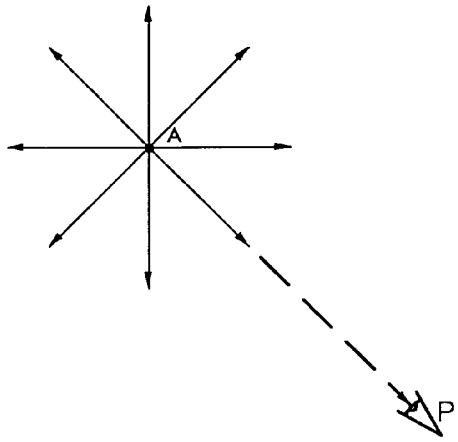
FIG. 5A illustrates a single point source.

FIG. 5A shows light rays emitted from a single point source A. By definition, all light rays emanate from this single point and travel in all directions. As a result, only a single ray passes through a given observation point P. This highly simplified model is often used in optical calculations, but is only valid for infinitely small light sources, or in situations where the light source is infinitely far away from the observer. In general, all real light sources are not confined to a single point, but are rather extended sources with a significant emitting surface which cannot be neglected.

Figure 5B:
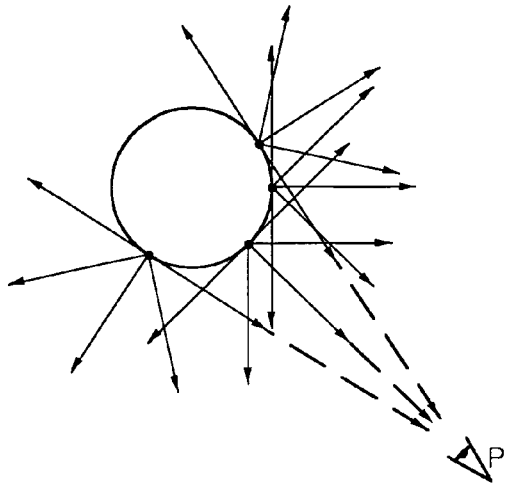
FIG. 5B illustrates an extended source, in accordance with one embodiment of the present invention.

In contrast, FIG. 5B shows light emitted from an extended source. In this case the source is shown to have a circular shape; however, the shape is arbitrary. The important concept to grasp is that every point on the surface of the source acts as an individual point source emitting light in all directions. It is as if the surface of an extended source is made up of an infinite number of point sources. As a result, it can be seen that many light rays pass through an observation point P, rather than only one, as in the case of the single point source (only three are shown).

Figure 5C:
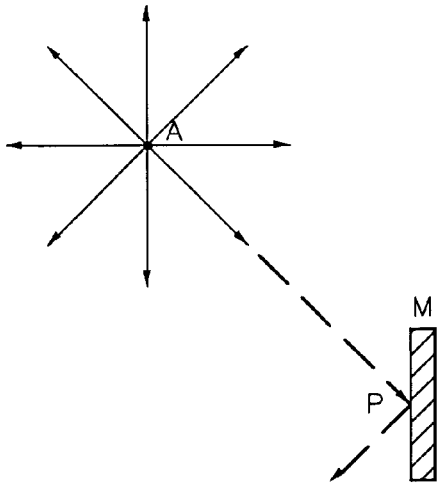
FIG. 5C illustrates a single point source light ray reflecting from a mirrored surface.
Figure 5D:
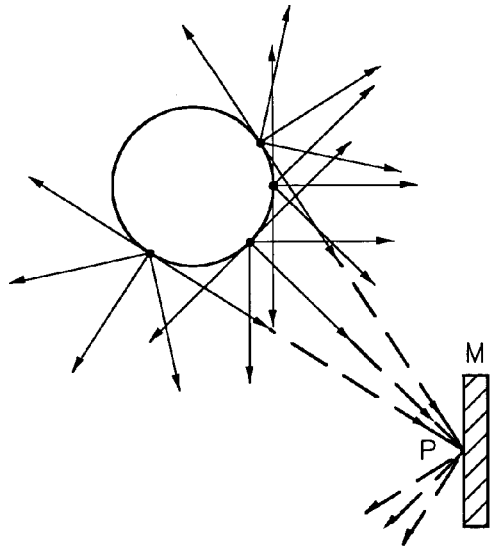
FIG. 5D illustrates an extended source with multiple light rays reflecting from a mirrored surface, in accordance with one embodiment of the present invention.

To further understand the importance of this difference, now consider that a mirror M is placed at the observation point. In FIG. 5C it can be seen that at point P, where the light ray hits the mirror's surface, only a single light ray is reflected. However, in the case of the extended source (FIG. 5D) many rays strike the surface of the mirror at point P and are reflected. Moreover, the light rays that converge at point P diverge as they are reflected from the mirrored surface. This divergence of the reflected light rays is very important in the discussion of the invention.

Figure 6A:
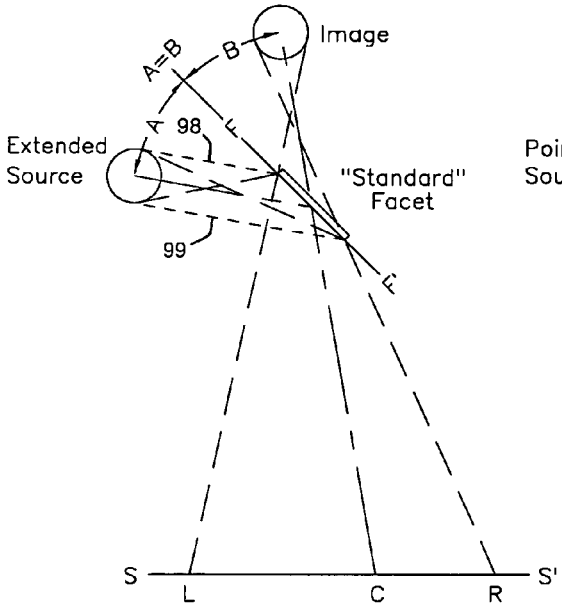
FIG. 6A shows the range of the rays created by an extended source and reflected by a "standard" facet on to the surface of interest, in accordance with basic optical principles.

In FIG. 6A, a facet is aligned on axis F-F', and made just wide enough to include the parallel edge rays 98 and 99 from an extended source. This may be referred to as a "Standard" facet. All light rays incident on the mirrored surface will leave the surface with an exit angle equal to the angle of incidence, as shown, illuminating the baseline S-S' from L to R.

Figure 6B:
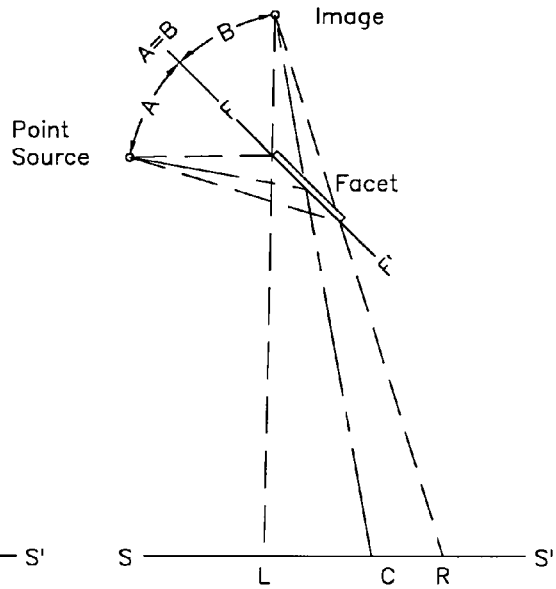
FIG. 6B shows the range of the rays created by a point source and reflected by a facet on to the surface of interest, in accordance with basic optical principles.

In FIG. 6B, however, with an identical facet, but a point source, the illuminated portion L to R of the baseline S-S' is considerably smaller. In most prior art this distinction is vague, or ignored completely. Furthermore, little attention is given to calculation or actual measurement of the true power contour of the various reflector designs in prior art.

Figure 6C:
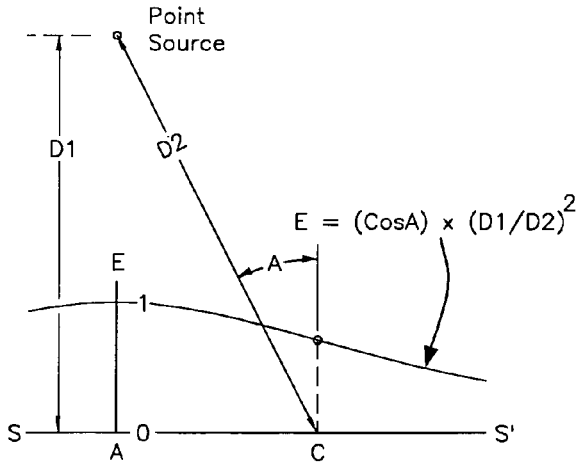
FIG. 6C illustrates a method of measurement, on the surface of interest, of the direct energy output from a point source in accordance with basic optical principles.

FIG. 6C illustrates the basic principle by which a source above a work surface illuminates an area of interest. If we assume that D1 and D2 are large compared to the width of the source, the relative illuminance E at any point on the surface of interest S-S' is calculated by:

$$\text{Relative illuminance } (E)=(\cos A)\times(D1/D2)^2$$

At point A, where the distance from the source to plane S-S' is minimum, the illuminance is maximum, and E=1 on the vertical scale. At C and all other points, E can now be accurately plotted as shown. Note that, within the limits stated above, the source size is not important. The same curve is obtained from either a point or extended source. Throughout the following discussion, the photometric measurement of the fluorescent tube alone will be used to establish a reference point=1 on a vertical scale for all subsequent energy plots.

No reflective surface is 100% efficient, and the resulting losses should be considered as well. However, throughout the following discussion they will be ignored.

Figure 7:
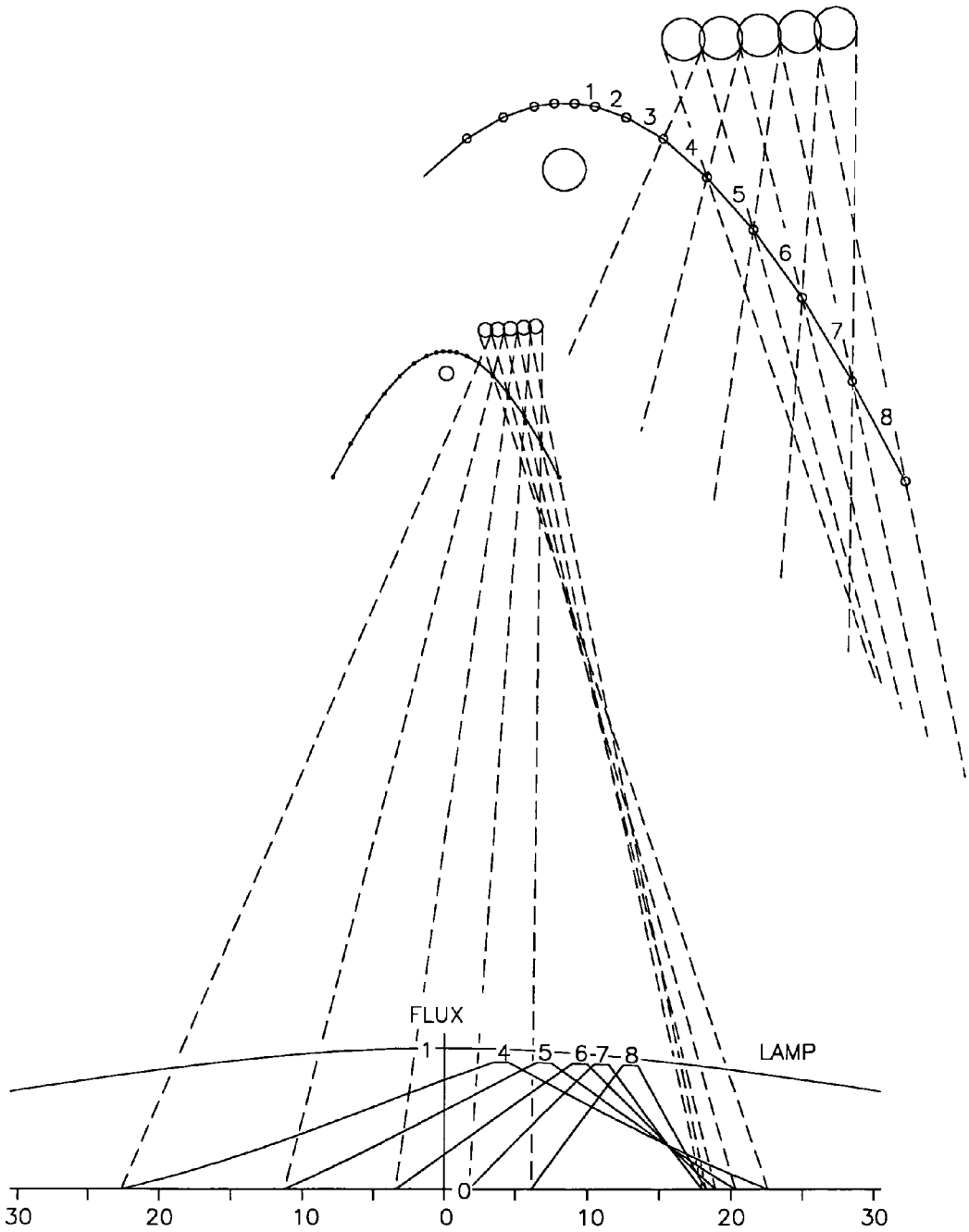
FIG. 7 shows an outer reflector made up of a plurality of facets and their energy output, in accordance with one embodiment of the present invention.

The design of the outer reflector will now be discussed. FIG. 7 shows an outer reflector made up of a plurality of facets, numbered 1 through 8, which are connected in succession. Here E is calculated and plotted for the standard facets 4, 5, 6, 7, and 8, according to the rules just described in FIG. 6. Note that the output from facet 4, close to the source, has a wide range across the work surface while facet 8 covers a much smaller area. E of the bare lamp is also shown. Notice that none of the facets produce a peak output equal to the direct lamp output. This is caused by the greater distance from the image to a given point on the work surface vs. the direct distance to the source.

Figure 8:
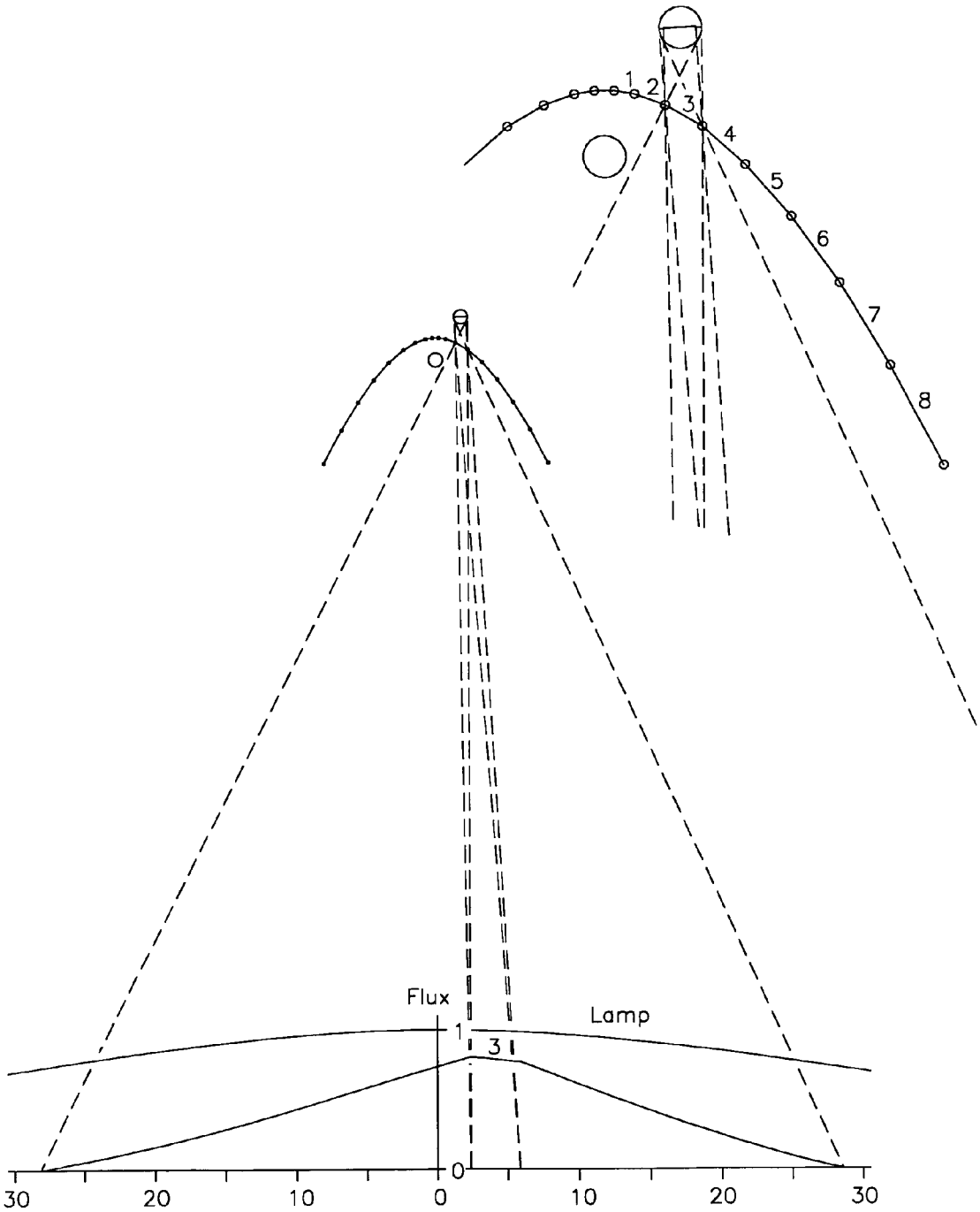
FIG. 8 shows the energy output provided by a particular facet, in accordance with one embodiment of the present invention.

Referring to FIG. 8, since facet 3 is very close to the lamp, it is reduced in width to limit the edge rays on the work surface to +/−30 inches. Notice, in the magnified view, there is now no point on the target plane where the full image of the source is included within the facet, so the peak output is correspondingly reduced, compared to facets 4 through 8 (in FIG. 7).

Figure 9:
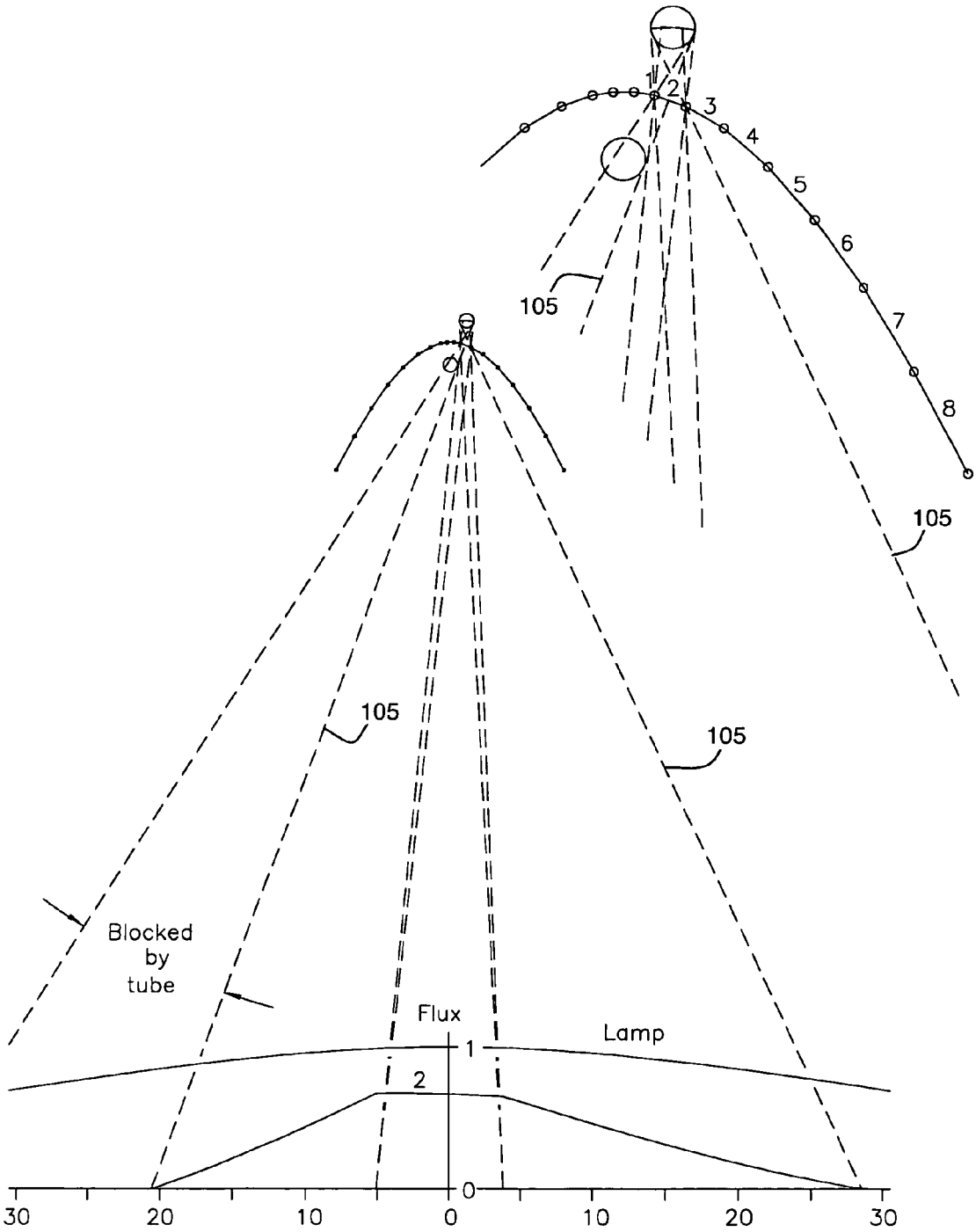
FIG. 9 shows the energy output provided by another facet, in accordance with one embodiment of the present invention.

Referring to FIG. 9, facet 2 is made even smaller so that its right edge rays do not exceed +30 inches, while the left edge rays are now severely blocked by the tube. Only the light energy within the edge rays 105 illuminates the work surface. The peak output is correspondingly lower, due to the reduced width of the image in the facet "window".

Figure 10:
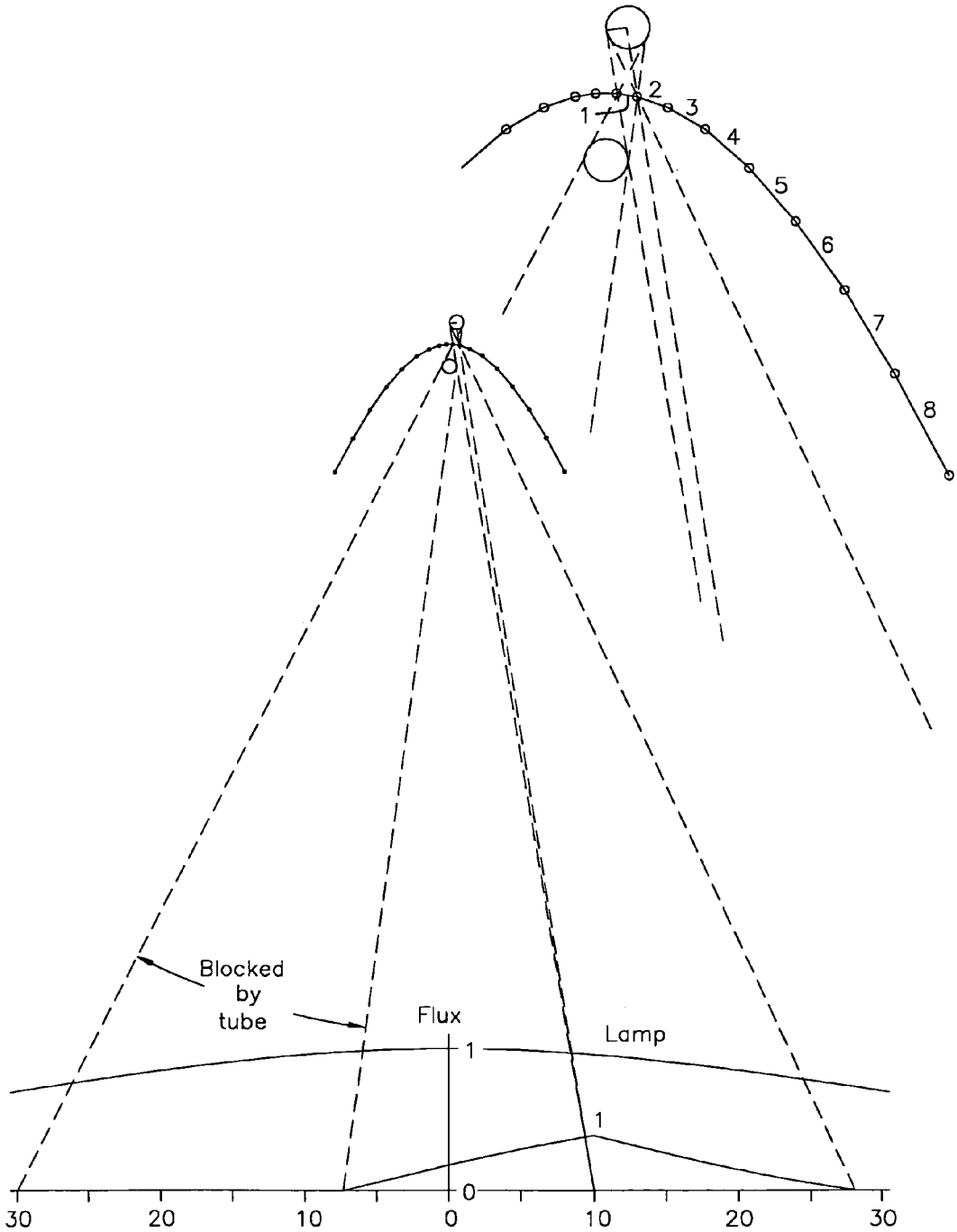
FIG. 10 shows the energy output provided by another facet, in accordance with one embodiment of the present invention.

Referring to FIG. 10, facet 1 is even smaller, with a major portion of its energy now blocked by the lamp. However, if we were to angle downward facets 1, 2, and 3 the right side outer edge rays would go beyond the 30 inch limit. We will see later in this discussion that this facet does indeed contribute to the overall output.

Figure 11:
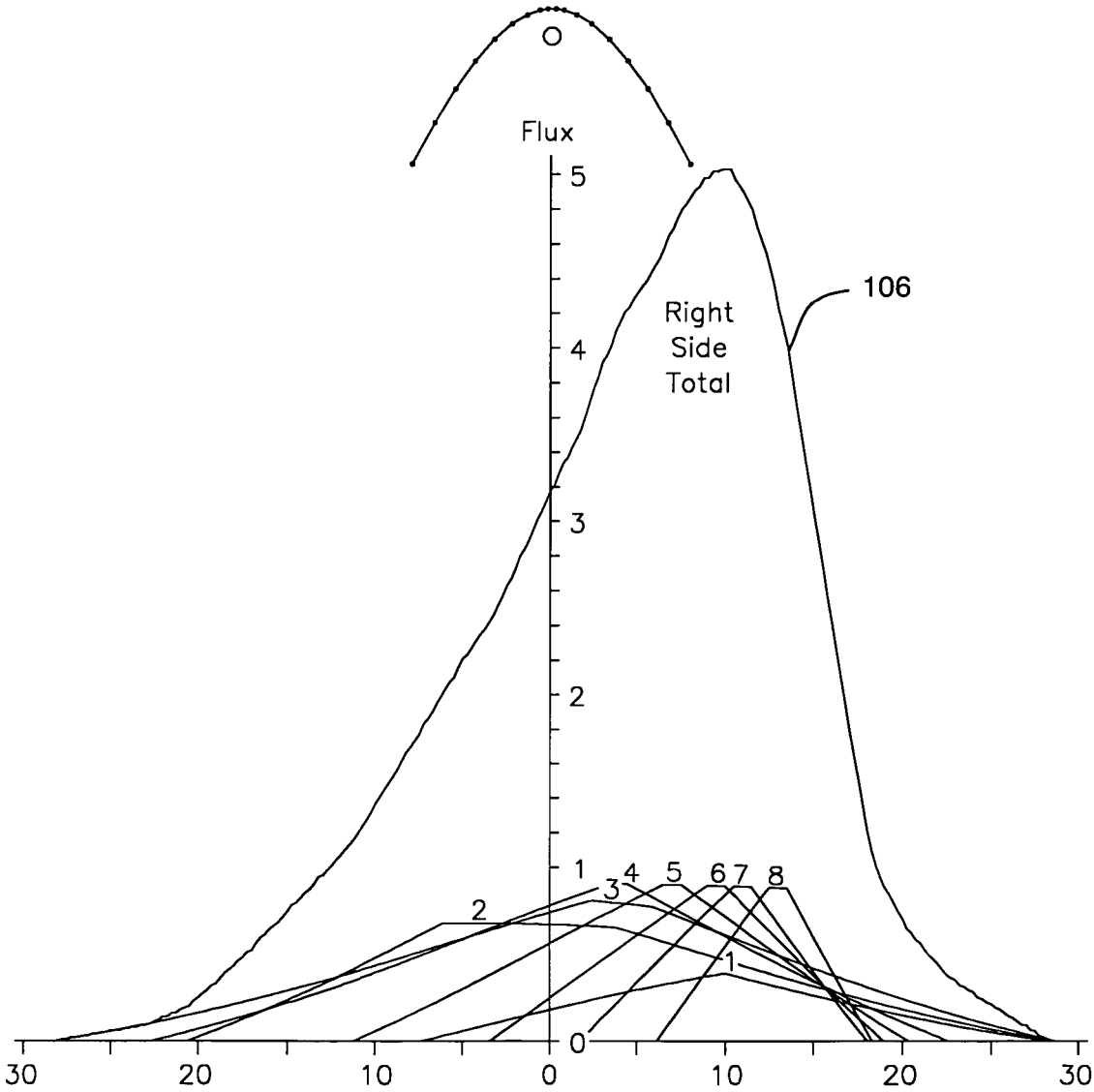
FIG. 11 shows the energy output from all the facets on one side of the light fixture, in accordance with one embodiment of the present invention.

Referring to FIG. 11, we can now extend the vertical scale and add all energy from facets 1 through 8. The total curve 106 is shown. It appears very far from being a flat output.

Figure 12:
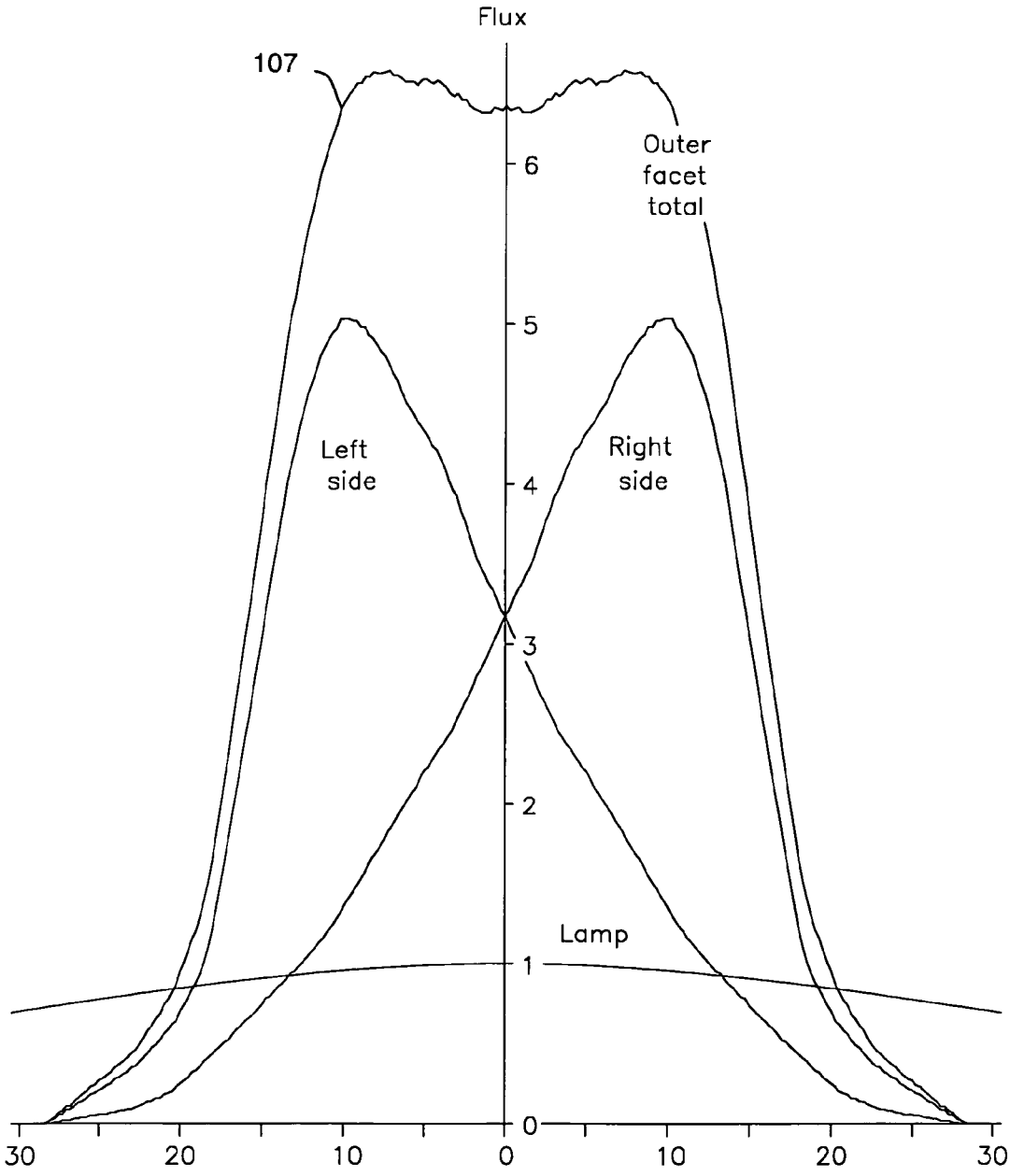
FIG. 12 shows the energy output from both sides of the light fixture, in accordance with one embodiment of the present invention.

Referring to FIG. 12, since this is a symmetrical reflector, we can now mirror the right side total to the left side and add the two curves together (as shown). The result is a relatively flat total output 107, with a trough in the middle which is done deliberately, for reasons that will be apparent later on. Note that the total output from the outer facets is more than six times greater than the bare lamp itself.

Figure 13:
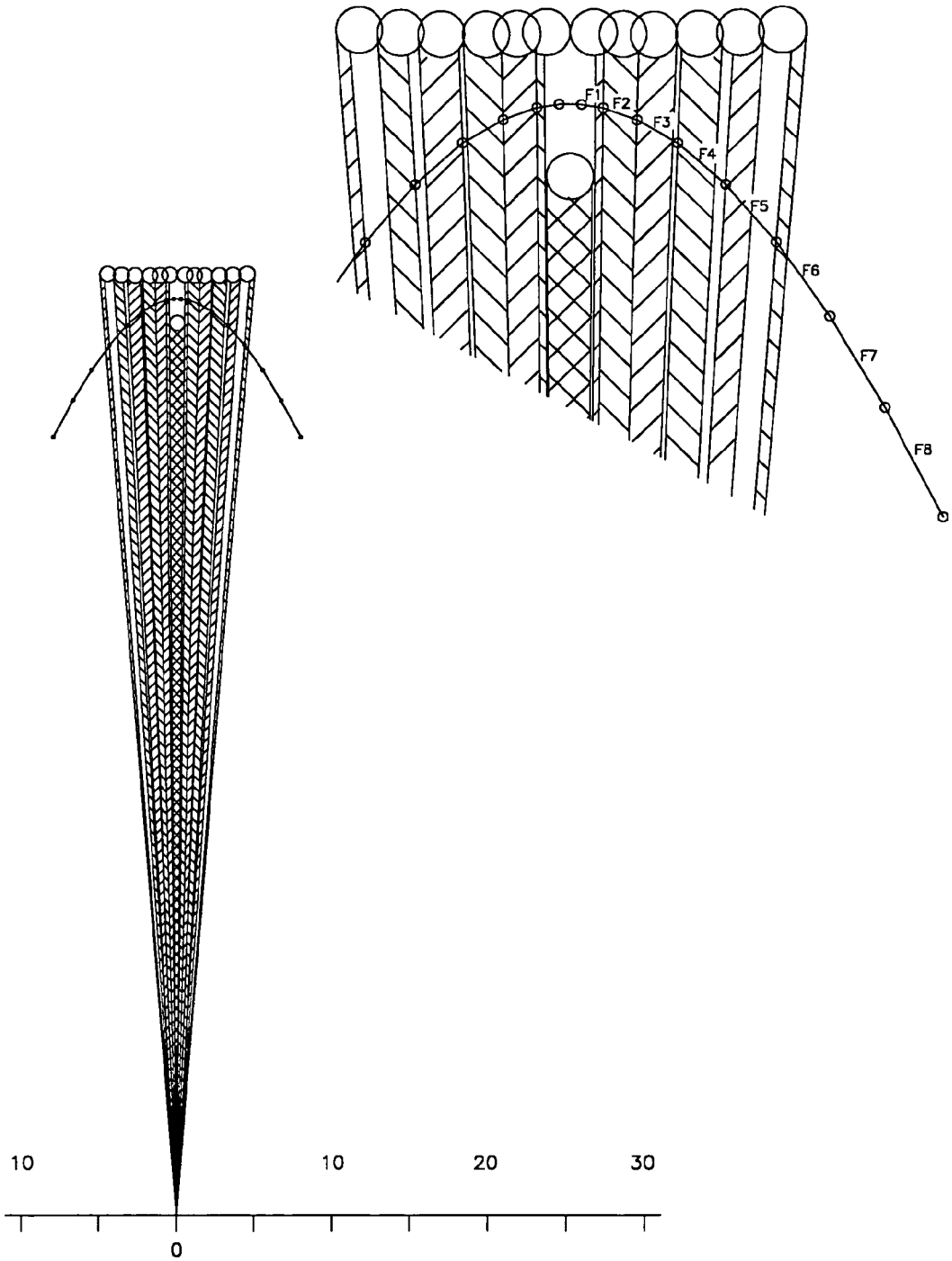
FIG. 13 shows an array of images produced by the outer reflector at the center of the surface of interest, in accordance with one embodiment of the present invention.

FIG. 13 shows how the light fixture achieves its very high efficiency. From the center of the work surface, looking up at the reflector, the tube is flanked by an array of images that appear almost as bright as the tube itself. Near the center, the images produce a nearly continuous bright surface. Towards the outer edges smaller portions of the images appear. Notice that the small amount of energy from F1 fills the gap between the tube and F2.

Figure 14:
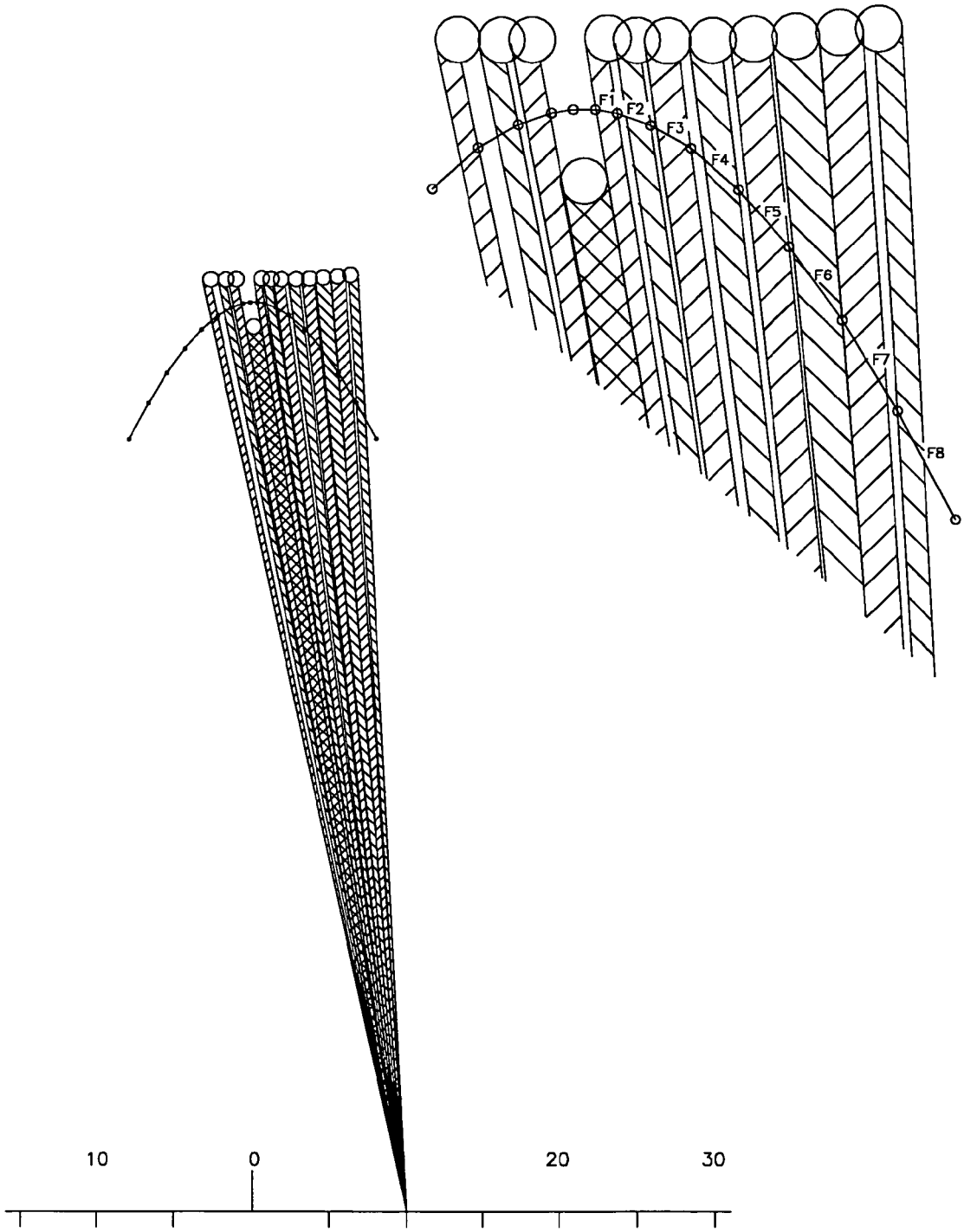
FIG. 14 shows an array of images produced by the outer reflector at one side of the surface of interest, in accordance with one embodiment of the present invention.

In FIG. 14, looking up at the reflector from a point on the work surface 10 inches from the center, a different but equivalent array of images appears. At this location, F1 contributes a greater output and there are now greater spaces between the images. However the total output of all these tube images is very similar to that achieved at the center in FIG. 13.

Figure 15:
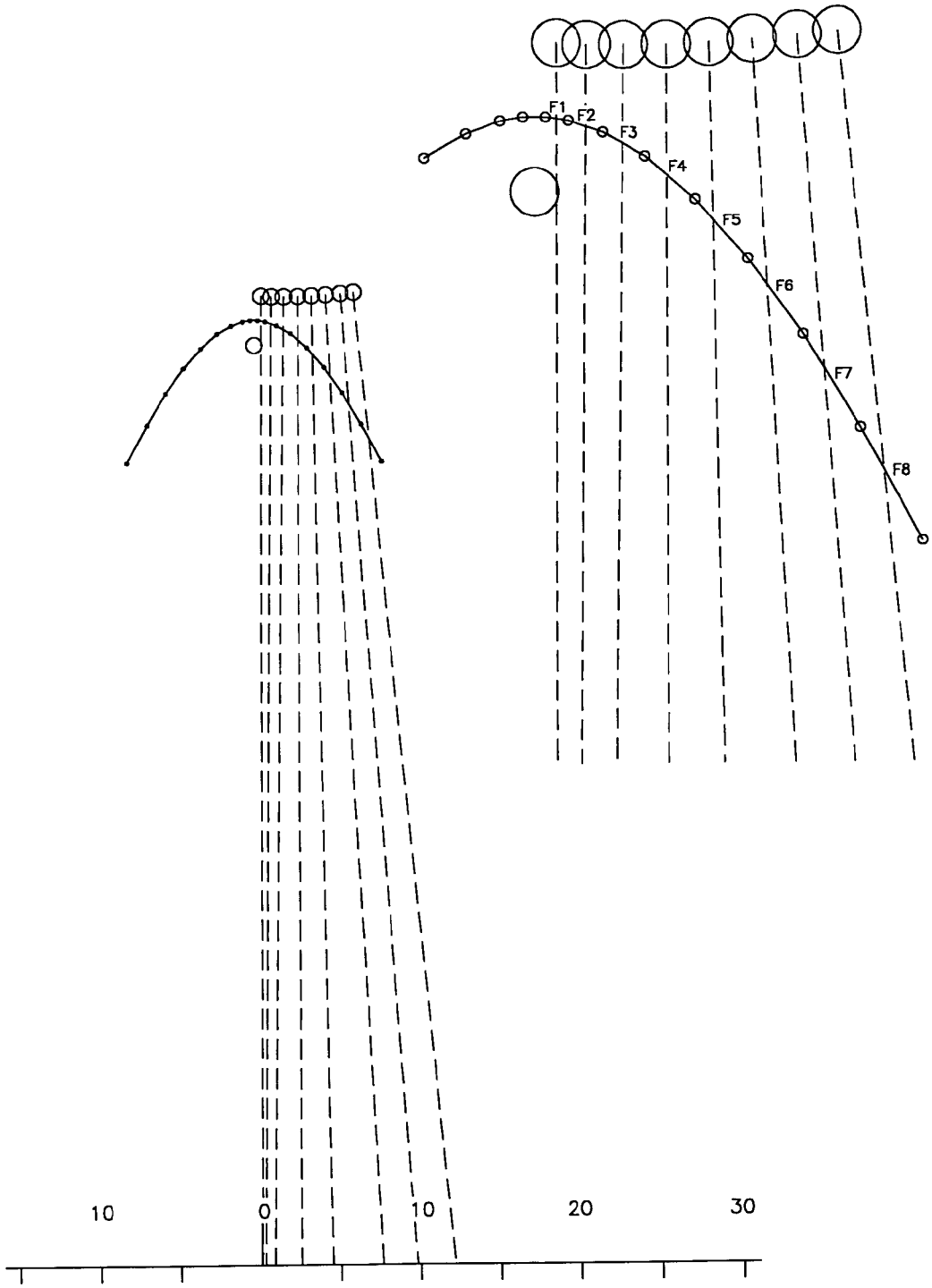
FIG. 15 shows how the outer reflector is not equivalent to a parabola, in accordance with one embodiment of the present invention.

FIG. 15 illustrates that while the outer reflector appears to be a parabola, it is not really a parabola. The center rays (drawn from the center of each image to the middle of its facet) when extended to the baseline are shown to be crowded towards zero for facets 1, 2, and 3, while the center rays for facets F5, F6, F7, and F8 increasingly diverge outward from the center. Only the center ray of facet F4 is parallel to the center axis. This differs from a parabola, which by definition creates all parallel rays which originate from a point source located at the focus. Instead, as described earlier, each facet angle and size was calculated to place an accurate energy curve in the proper location so the total of all would produce the output desired. The low output from facets 1, 2, and 3 is improved by aiming them together near the center to increase the energy at that point, while facets 4 through 8 are aimed outward to spread their energy across the total area of the work surface.

Figure 16:
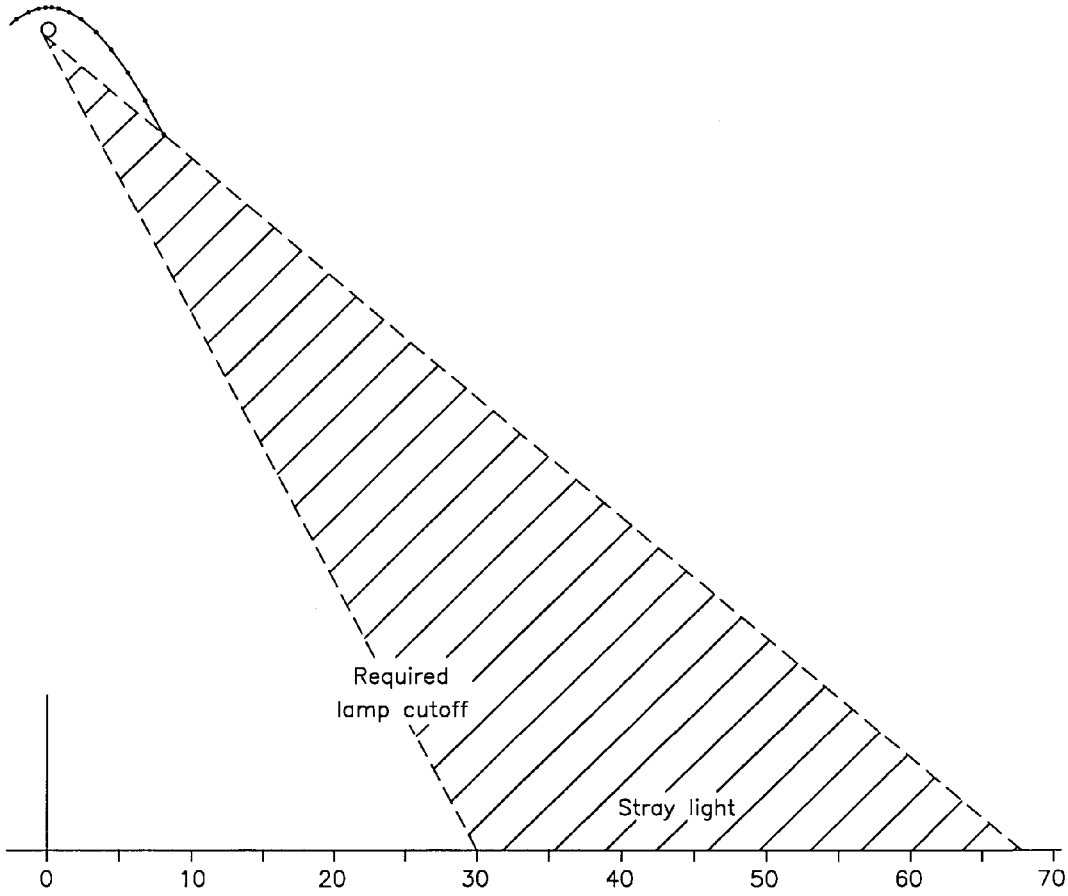
FIG. 16 shows that even when using an outer reflector, a considerable amount of stray light is still traveling outside the target area, in accordance with one embodiment of the present invention.

In FIG. 16, however, we see that while the reflected energy from the facets is all within the +/−30 inch limits, a considerable amount of stray light direct from the tube itself ranges all the way out to nearly 70 inches, far beyond the desired target area.

Figure 17:
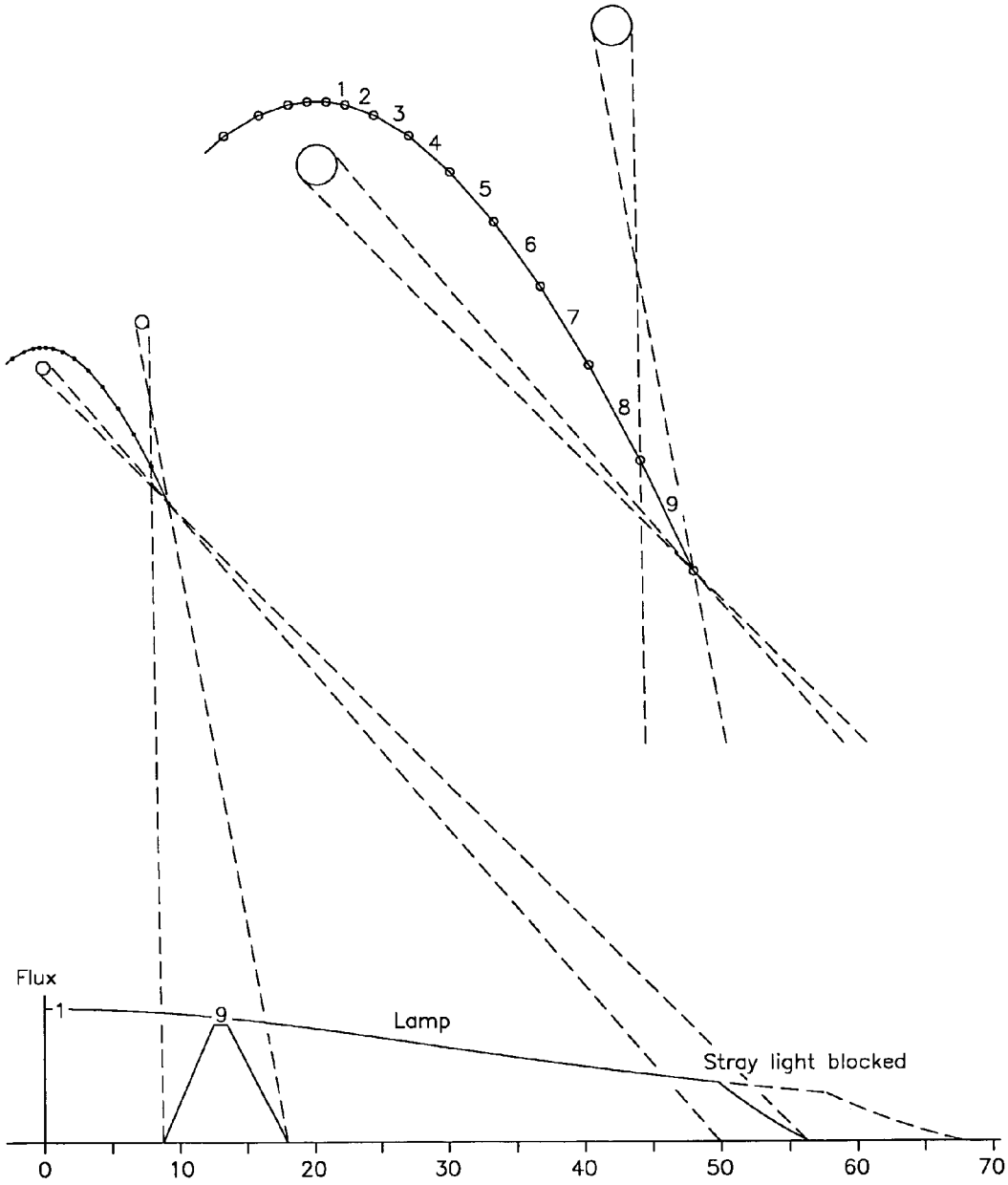
FIG. 17 shows another facet being added to the outer reflector to reduce stray light, in accordance with one embodiment of the present invention.

In FIG. 17, another facet 9 has been added to reduce the stray light and direct additional energy into the target area. However, the reflector is now increased in depth, and only a small reduction of the stray light is achieved.

Figure 18:
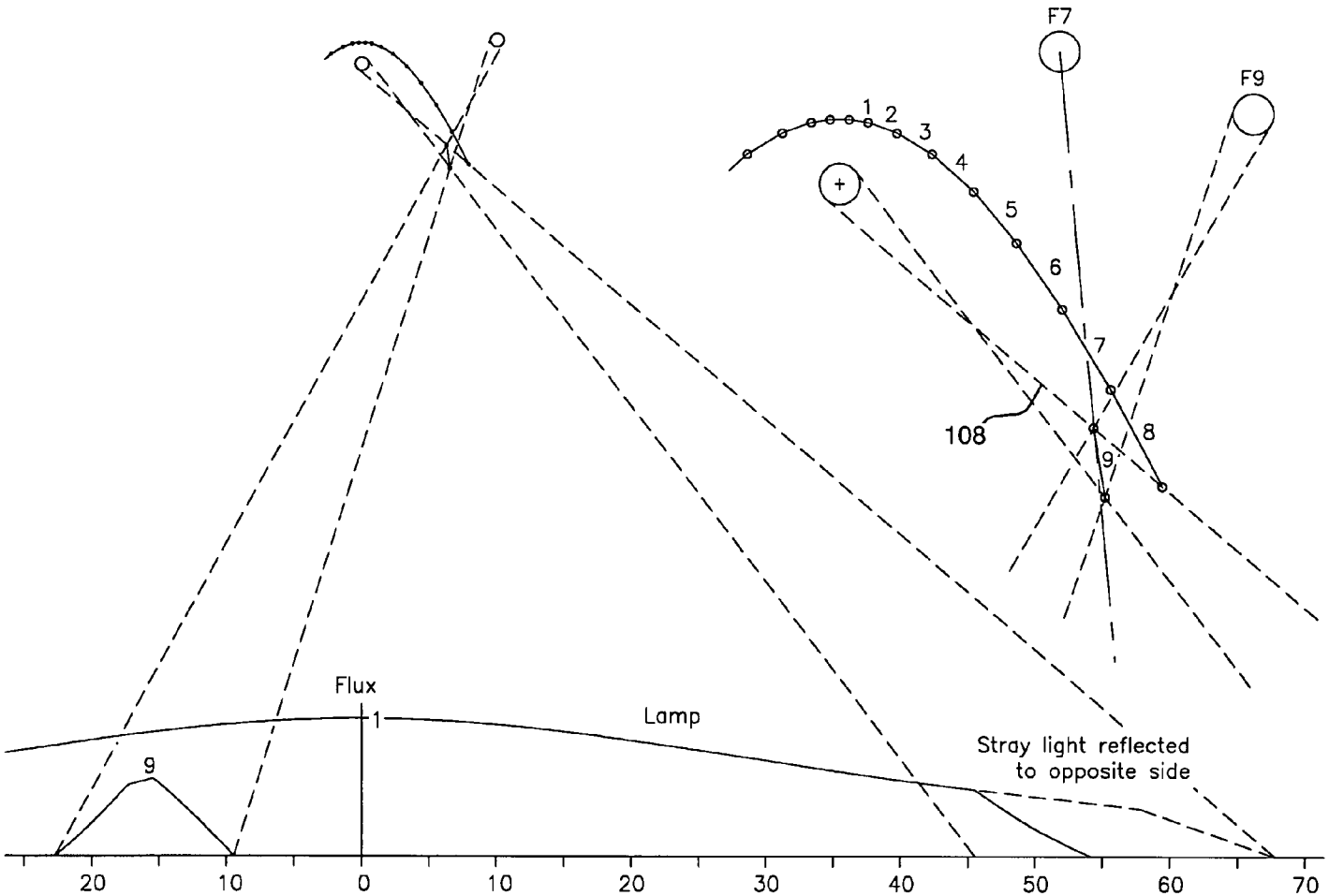
FIG. 18 shows an inner facet placed inside the outer reflector, in accordance with one embodiment of the present invention.

In FIG. 18, an equivalent facet 9 has been moved inside the reflector itself to achieve a similar amount of stray light reduction. It is nearly in line with the center rays of facet 7, thus having relatively small effect on its output. Also, facet 9 is placed so that its top edge does not intercept the direct rays 108 from the tube to facet 8. The energy from the new internal facet 9 now appears on the opposite side of the center axis. This results from the nearly vertical alignment of facet 9.

Figure 19:
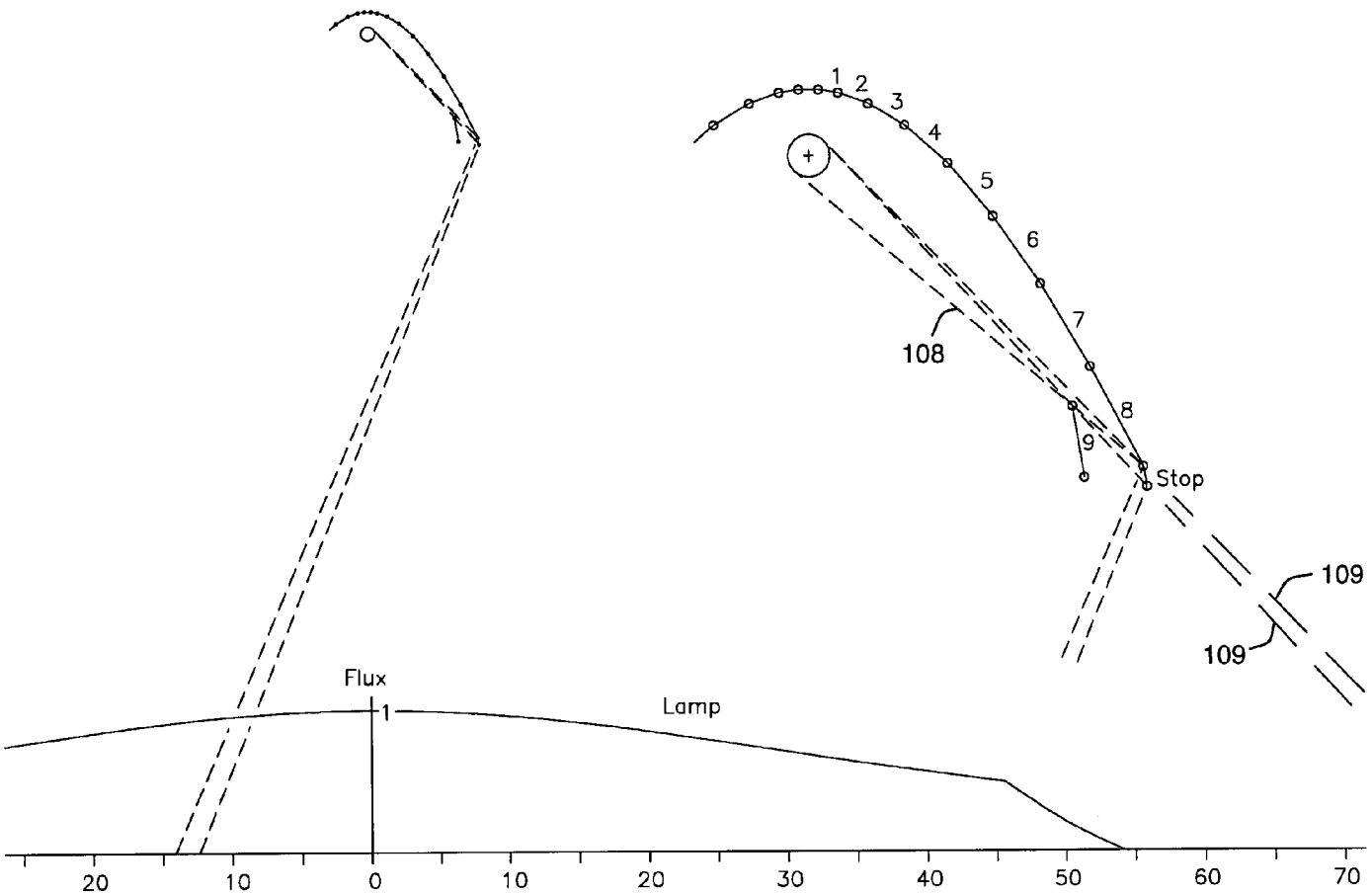
FIG. 19 shows the addition of a "Stop" facet to block stray light, in accordance with one embodiment of the present invention.

FIG. 19 shows that the top edge rays 109 from the tube would still allow some stray light to leak through between facets 8 and 9, therefore a small 'Stop' facet is added to eliminate this small amount of light. The Stop facet may be mirrored to reflect it to the other side, or it may have a non-reflective surface to simply absorb it.

Figure 20:
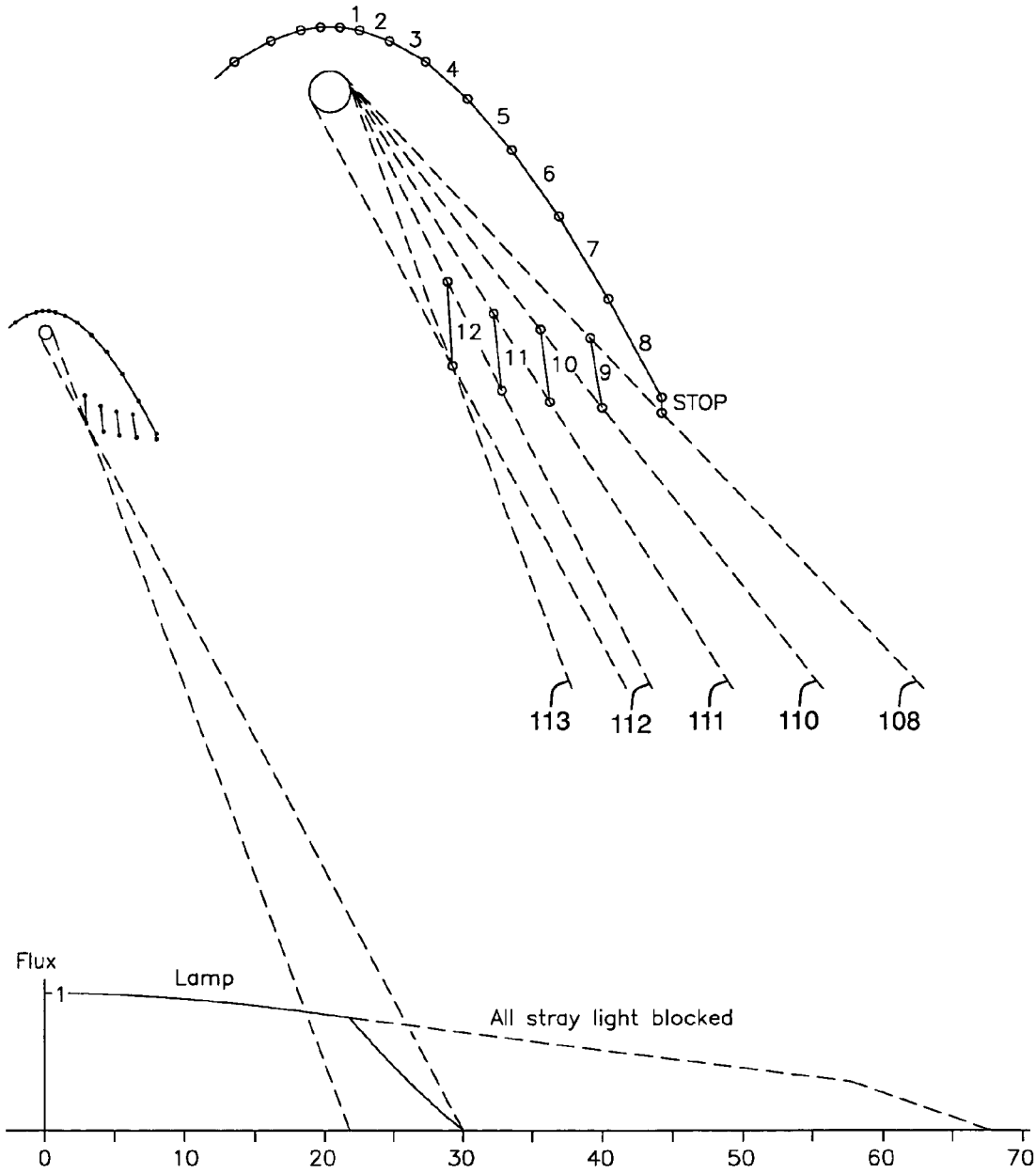
FIG. 20 shows additional inner facets being placed inside the outer reflector, in accordance with one embodiment of the present invention.

In FIG. 20, internal facets 10, 11, and 12 have also been added. Note that all rays between 108 and 110 are blocked by F9, rays between 110 and 111 are blocked by the next inside facet F10, and so forth, until all stray light from 108 to 113 is blocked, and the tube edge rays are limited to +/−30 inches. All stray light is now blocked.

Figure 21:
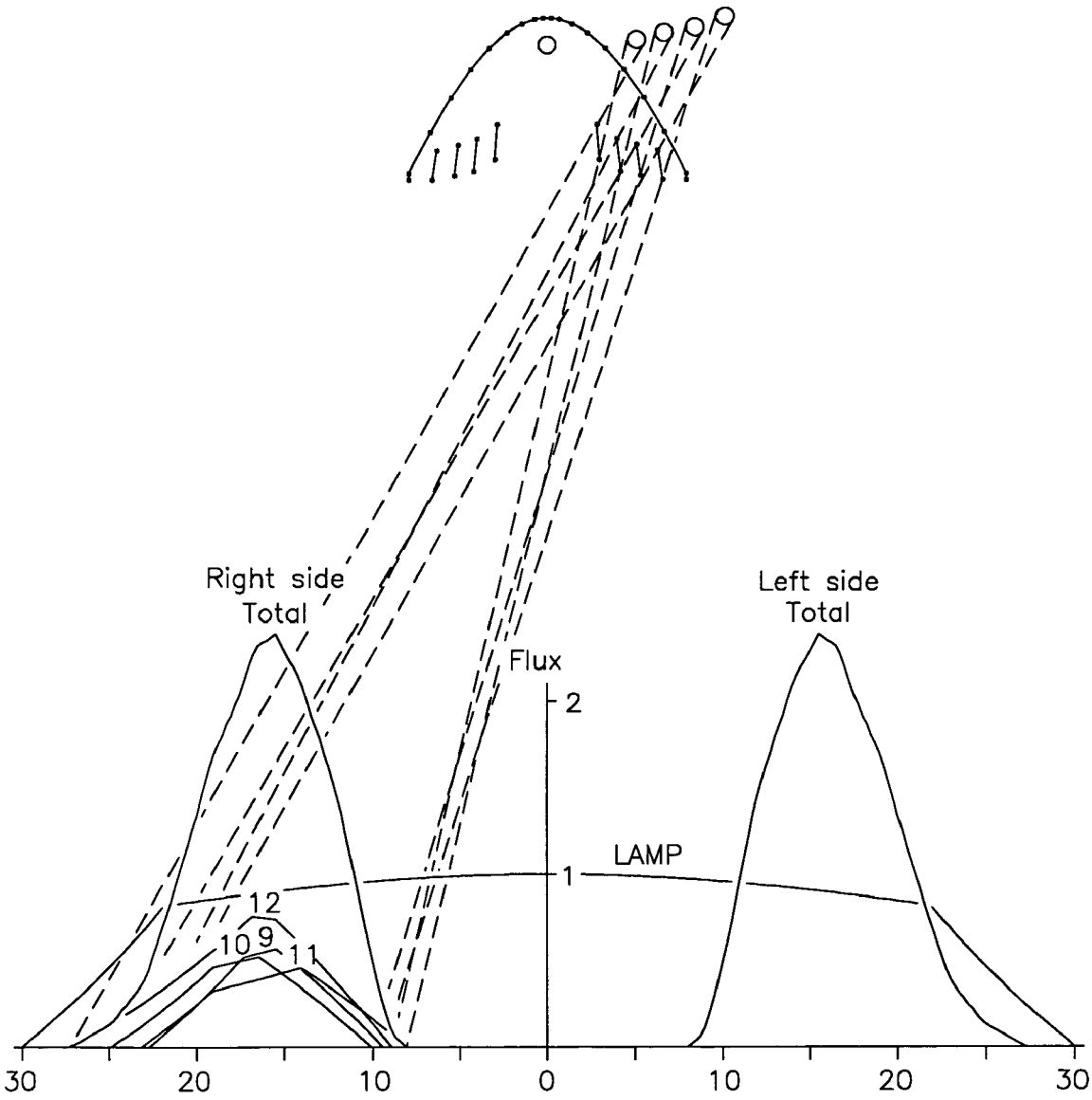
FIG. 21 shows the energy output from the internal facets on the right side of the reflector appearing on the left side of the target area, and the total energy on both sides, in accordance with one embodiment of the present invention.

In FIG. 21, all of the internal facets 9, 10, 11, and 12 are arranged so that none of their rays exceed the target area on the left side. Also, their reflected rays are not intercepted by the next inward facet. The energy curves from these internal facets are summed in a manner similar to that used for the outer facets (FIG. 11). Since this is a symmetrical reflector, this energy can be mirrored as shown. Note that the peak output of the internal facets on each side is more than twice the energy of the lamp at the center. Thus, the stray energy from the tube which would normally be an annoying glare is now useful energy within the target area.

In FIG. 18, the internal facet F9 appeared to have minimal effect on the rays from the external facet F7. But in FIG. 22, facet F5 has three facets F10, F11 and F12, interfering with its rays. This cannot be ignored. For example, F12 blocks a considerable portion of the F5 energy between rays 114 and 115, but since F12 is mirrored on its outside surface as well, it reflects these rays to add energy between rays 116 and 117, as shown.

Figure 23:
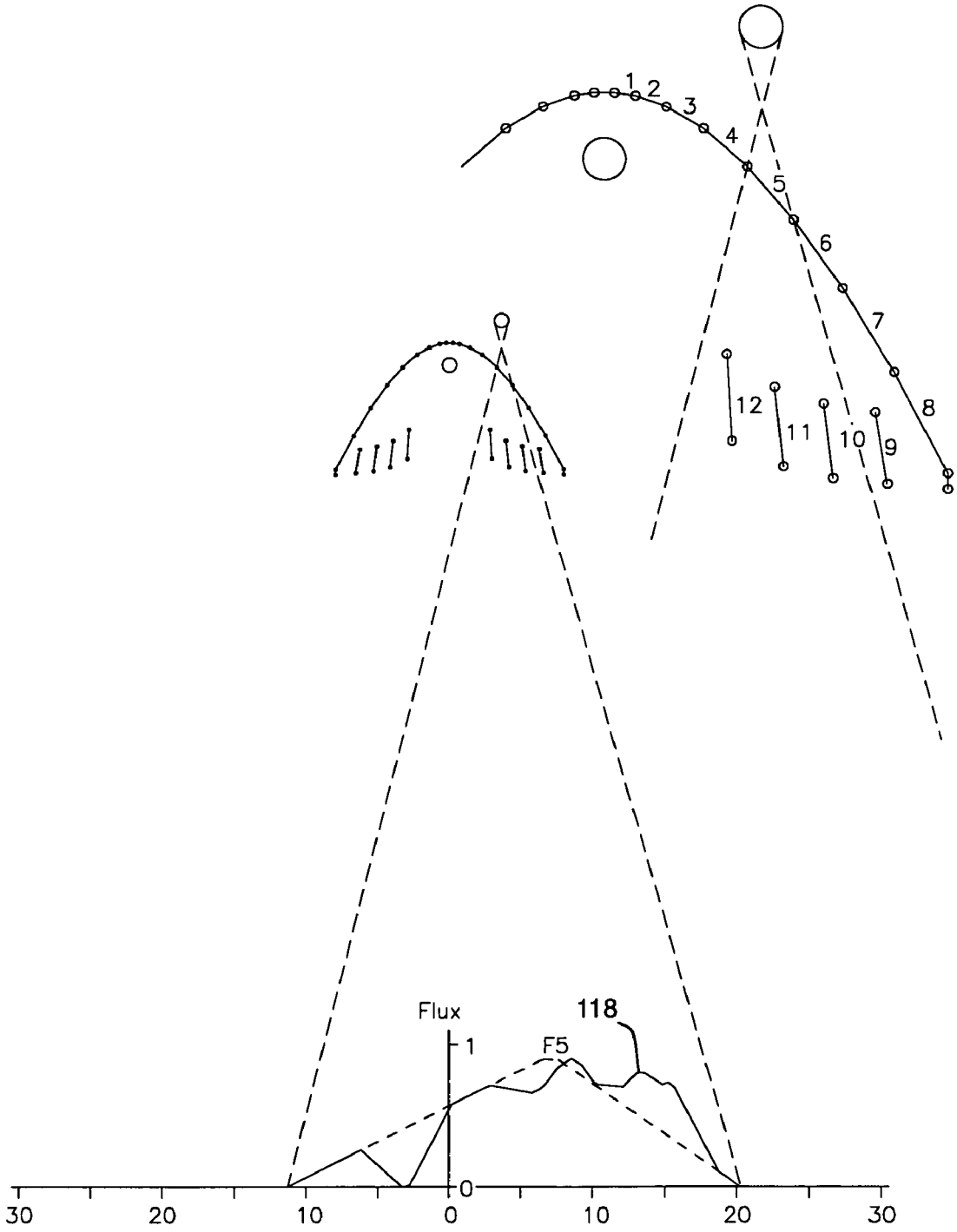
FIG. 23 shows the effect of interference from three inner facets with the energy provided by the same outer reflector facet, in accordance with one embodiment of the present invention.

In FIG. 23, the inner facets F10 and F11 have a similar and additional effect on the original F5 energy (in dotted lines), and produce the considerably modified new F5 total 118. Note, however, that no energy has been lost, merely shifted to one side.

Figure 22:
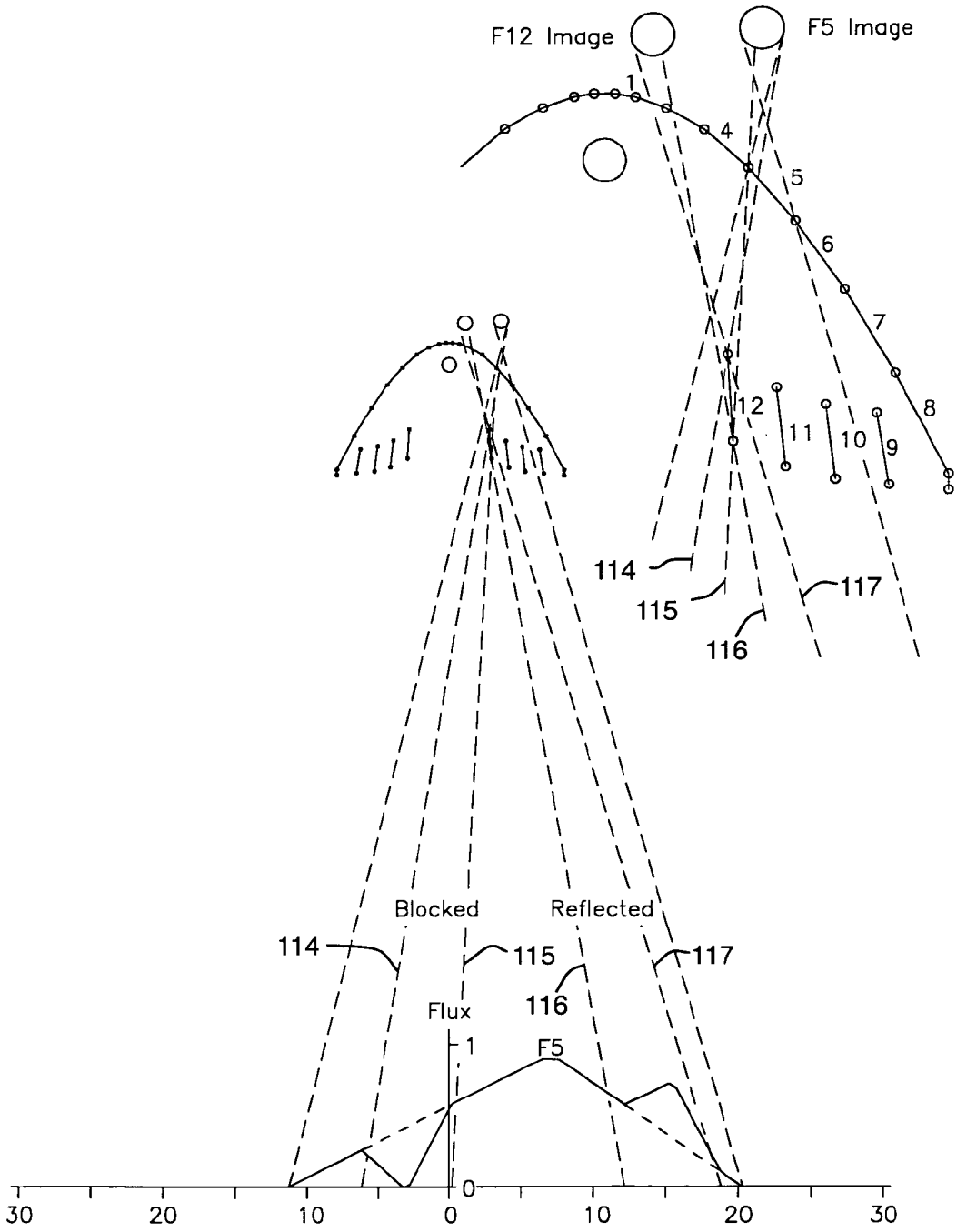
FIG. 22 shows the effect of interference from a single inner facet with the energy provided by a particular outer reflector facet, in accordance with one embodiment of the present invention.
Figure 24:
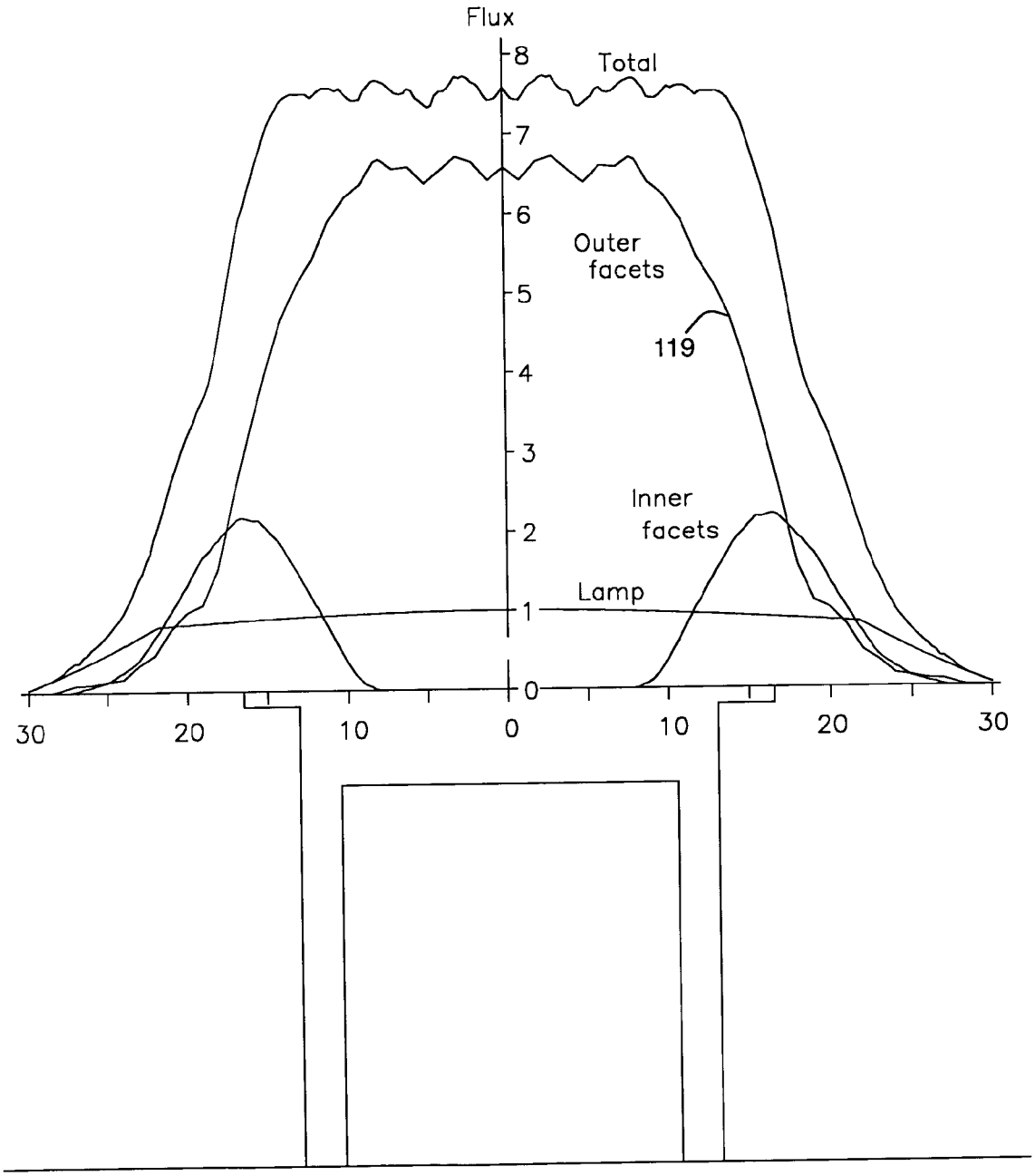
FIG. 24 shows the total power plot of the light fixture, (the sum of the individual power plots for (1) the lamp, (2) the inner reflector facets, and (3) the interference corrected outer facets, in accordance with one embodiment of the present invention.

In FIG. 24, the vertical scale has been reduced to fit the page. The power curve for the outer facets 119 is quite different than the version 107 illustrated in FIG. 12. The same technique is employed, but it is now the sum of the individually modified energy curves (obtained for each outer facet as shown in FIGS. 22 and 23). Now the individual power plots from the lamp, inner facets, and (interference corrected) outer facets are summed to produce the total energy output from the lamp and reflector combination. This total is more than 7 times greater than the lamp itself for nearly the full width of the table surface, with very rapid attenuation to zero at the +/−30 inch limits. The small positive and negative bumps in the total curve are not detectible by the human eye.

Figure 25:
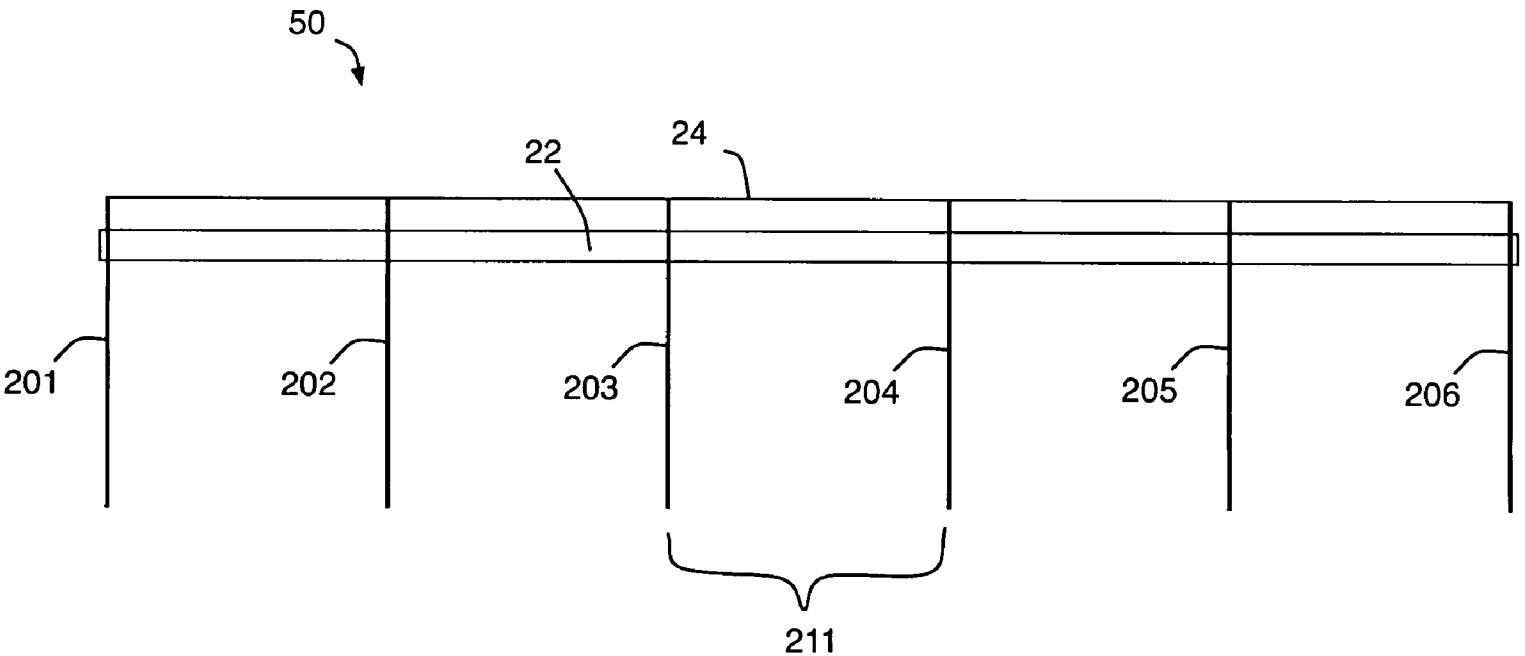
FIG. 25 is a side elevation view, in cross section, of a light fixture, in accordance with one embodiment of the present invention.

FIG. 25 is a side elevation view, in cross section, of a light fixture 200, in accordance with one embodiment of the present invention. The light fixture 200 is similar to the light fixture described above except that it additionally includes a plurality of partitions 201 through 206 for supporting the outer and/or internal reflectors 24 and 28. The partitions 201 through 206 are spatially separated along the longitudinal axis of the light fixture 200 thereby forming compartments 211. Furthermore, they have an outer shape that substantially matches the inner shape of the outer reflector 24. That is, they substantially fill the area defined by the outer reflector 24. In most cases, the partitions 201 through 206 are formed from thin plates or sheets, with reflective surfaces placed on both sides of the inner partitions 202 through 205 and on the inside of the end partitions 201 and 206. This has the effect of making them 'transparent' (similar to the facet described in FIG. 6A and B) and the full length of the light source will be effective at every point on the target area below the reflector, just as it would without the partitions.

Figure 26:
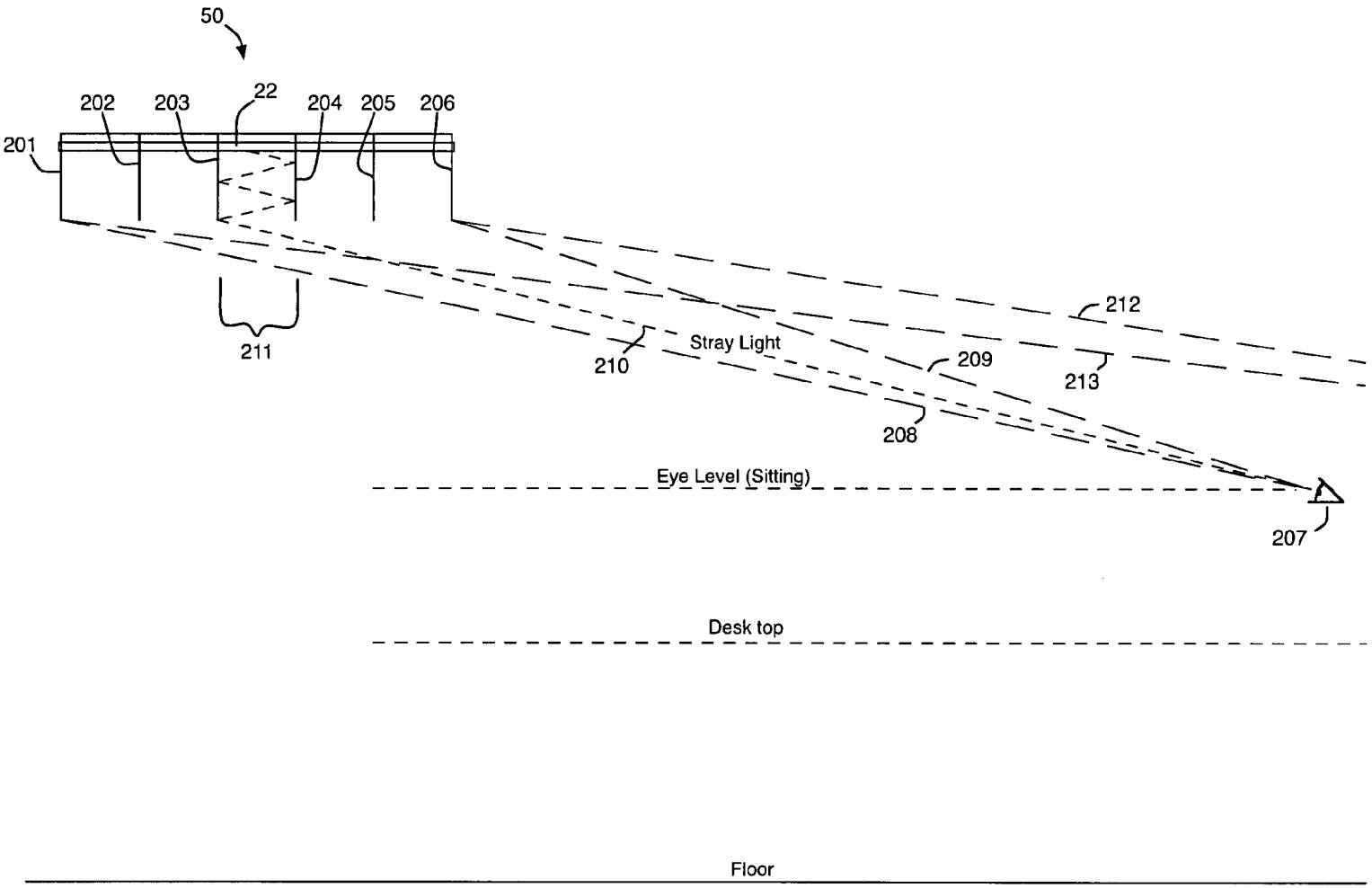
FIG. 26 is a similar view, of the light fixture of FIG. 25 including light rays from compartments with mirrored partitions, in accordance with one embodiment of the present invention.

FIG. 26 shows, however, that low angle stray light emitted from the light source 22 will bounce back and forth between the parallel reflective partitions 201 through 206 and eventually outside the opening of the outer reflector 24. This may produce annoying glare to an observer 207 located underneath and a considerable distance from the light fixture. The glare may exist through a solid angle defined by the exiting edge rays 208 and 209. Although edge rays 208 and 209 are shown, it should be noted that the stray light may actually extend to a much greater distance than shown (see for example the solid angle defined by rays 212 and 213). Furthermore, for ease of discussion, the path of a single typical ray 210 is also illustrated from a compartment 211 formed by a pair of inner partitions 203 and 204.

Figure 27:
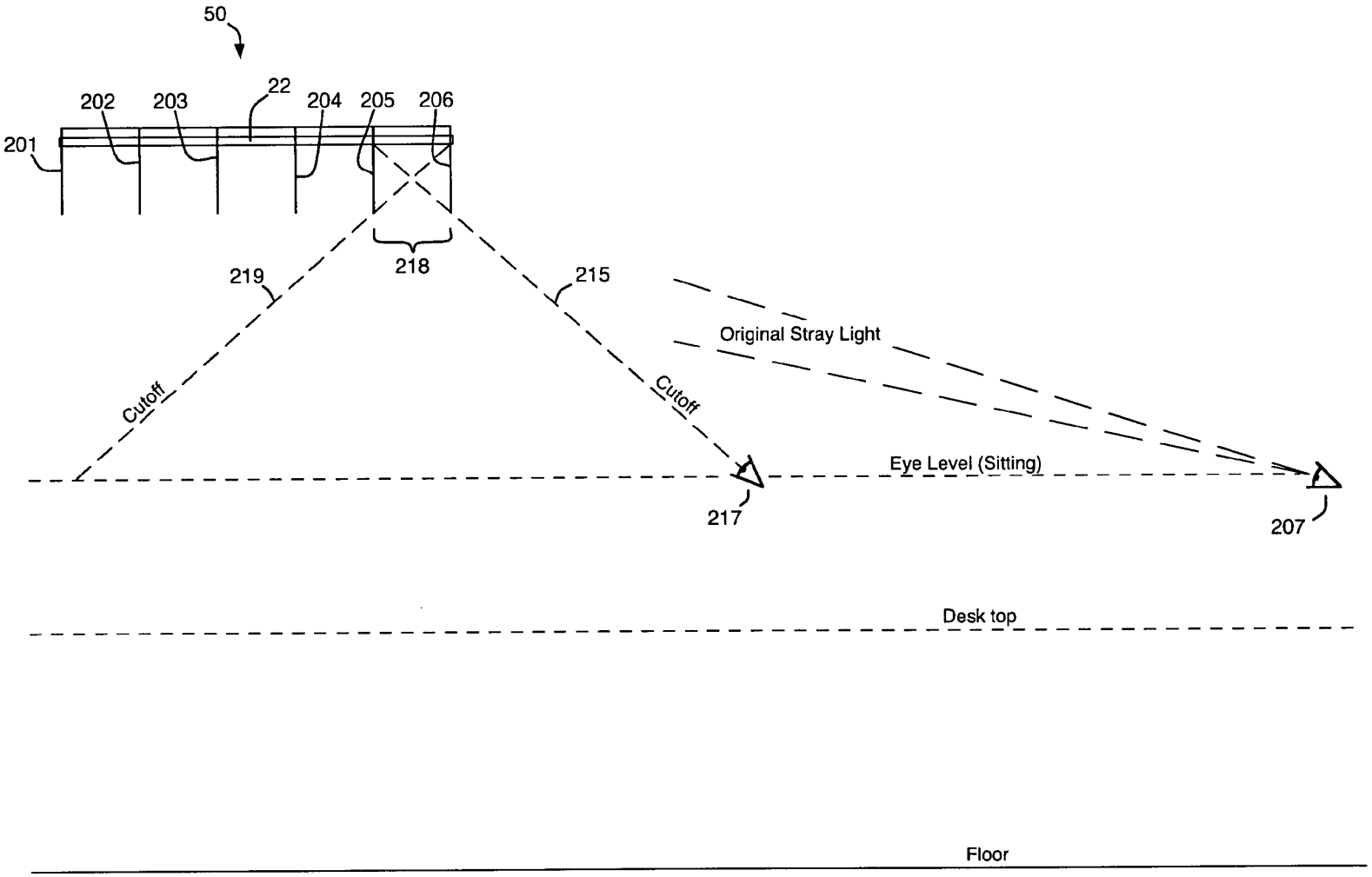
FIG. 27 is a similar view of the light fixture of FIG. 25 including light rays from a compartment with non-reflective partitions, in accordance with one embodiment of the present invention.

FIG. 27 shows how the end stray light can be greatly reduced by making the partitions non-reflective with black paint or other means. Thus, the stray light rays 210 bouncing back and forth between the mirrored partitions of FIG. 26 are eliminated. Now, the luminaire may be divided into a sufficient number of compartments 218 to produce the cut off edge rays 219 and 215, determined by the ratio of height to width. As shown, the observer located at position 207 will not see any glare and will just begin to see stray light when he moves closer to the light fixture 50 at position 217. Although only one compartment is shown, it should be appreciated that the other compartments produce identical output rays. However a considerable portion of the light produced by the lamp 22 will now be absorbed, greatly reducing the luminaire efficiency.

Figure 28A:
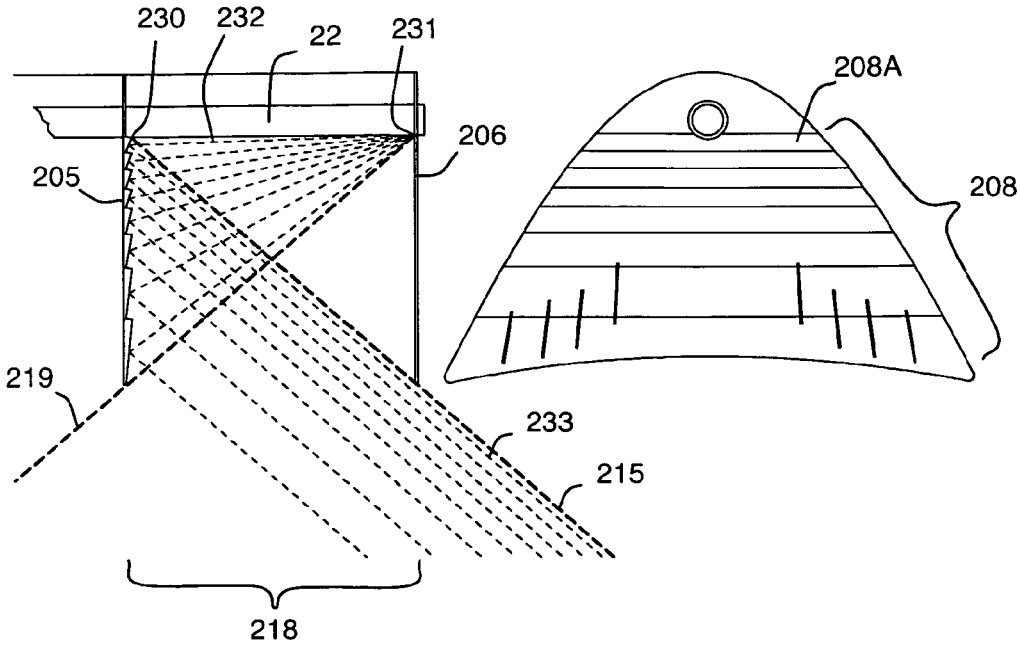
FIG. 28A is a magnified side view of an end compartment of the light fixture of FIG. 25 and its rays, in accordance with one embodiment of the present invention.

FIG. 28A shows how the end stray light may be usefully directed into the target area, rather than being absorbed. In the magnified views of compartment 218 enclosed by partitions 205 and 206 (from FIG. 27), angled facets 208 have been added. The facets 208 have plane reflective surfaces, and may extend the full width of the partition, but not necessarily the full height. The right edge ray 215 is generated by the surface of the tube at point 230. The equivalent point 231 on the other end of the fluorescent tube 22 generates the left edge ray 219 and also, at an extreme angle, ray 232. The top facet 208A is tilted to reflect ray 232 downward parallel to edge ray 215, and completely bypass the opposite partition 206. The other facets are progressively lengthened to lower their angle so that all the extreme rays from point 231 within the solid angle between ray 232 and 219 are also reflected parallel to ray 215. Thus, all the light radiating from point 231 on the fluorescent tube, that would normally be intercepted by partition 205 and reflected by a mirror surface (FIG. 26) to produce undesirable stray light, or absorbed by a black surface (FIG. 27) with a loss of efficiency, is now directed to the target area within the edge ray 215.

Figure 28B:
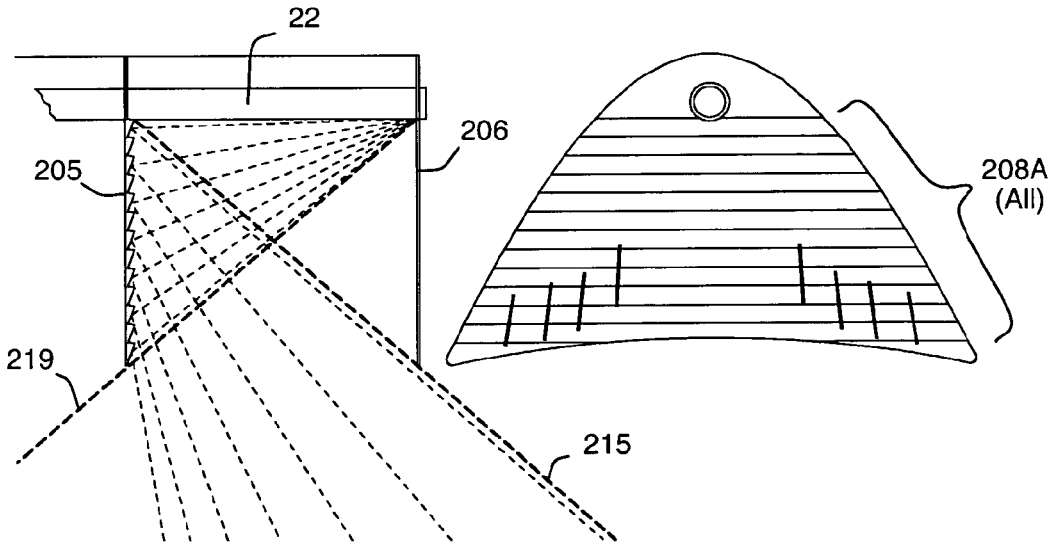
FIG. 28B is a similar view of the end compartment of the light fixture of FIG. 25 and its rays, in accordance with another embodiment of the present invention.

In FIG. 28B, instead of progressively changing facets, a larger number of facets identical to facet 208A are employed so the extreme rays from the critical end point 231 of the fluorescent tube 22 are reflected from the array of facets 208A, no longer parallel but instead, spread out on the target area. However, they are still within the edge rays 219 and 215.

The facet configuration need not be symmetrical on both sides of a compartment, and in less critical applications, facets may be necessary on only the upper areas of the partitions, to simplify manufacture. It may be desirable to adjust the facet angles and widths throughout the luminaire to achieve the most desirable longitudinal power curve in a manner similar to that used for adjusting the lateral power curve as described in FIGS. 18 through 23.

Figure 29:
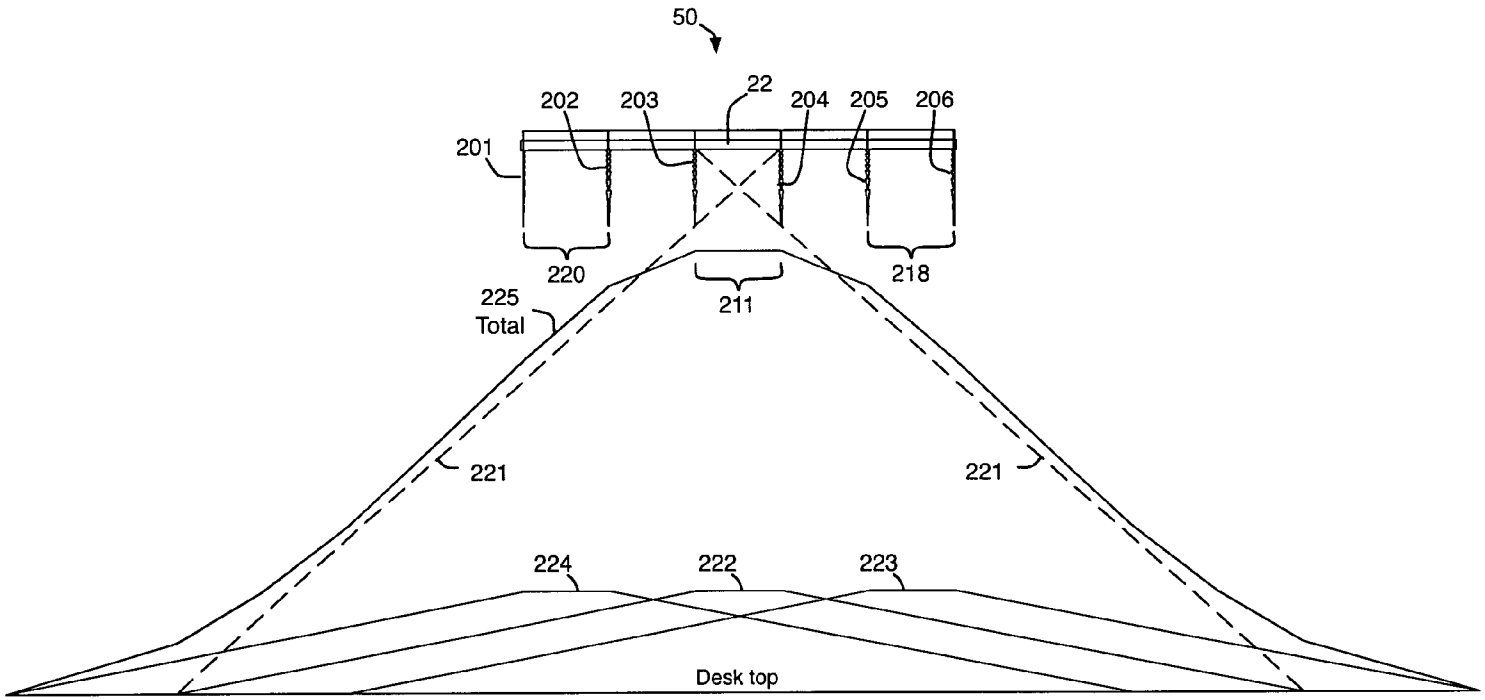
FIG. 29 shows typical power plots of the five identical faceted partitions, and the plot of total output (the sum of the individual power plots for the various compartments), in accordance with one embodiment of the present invention.
Figure 30:
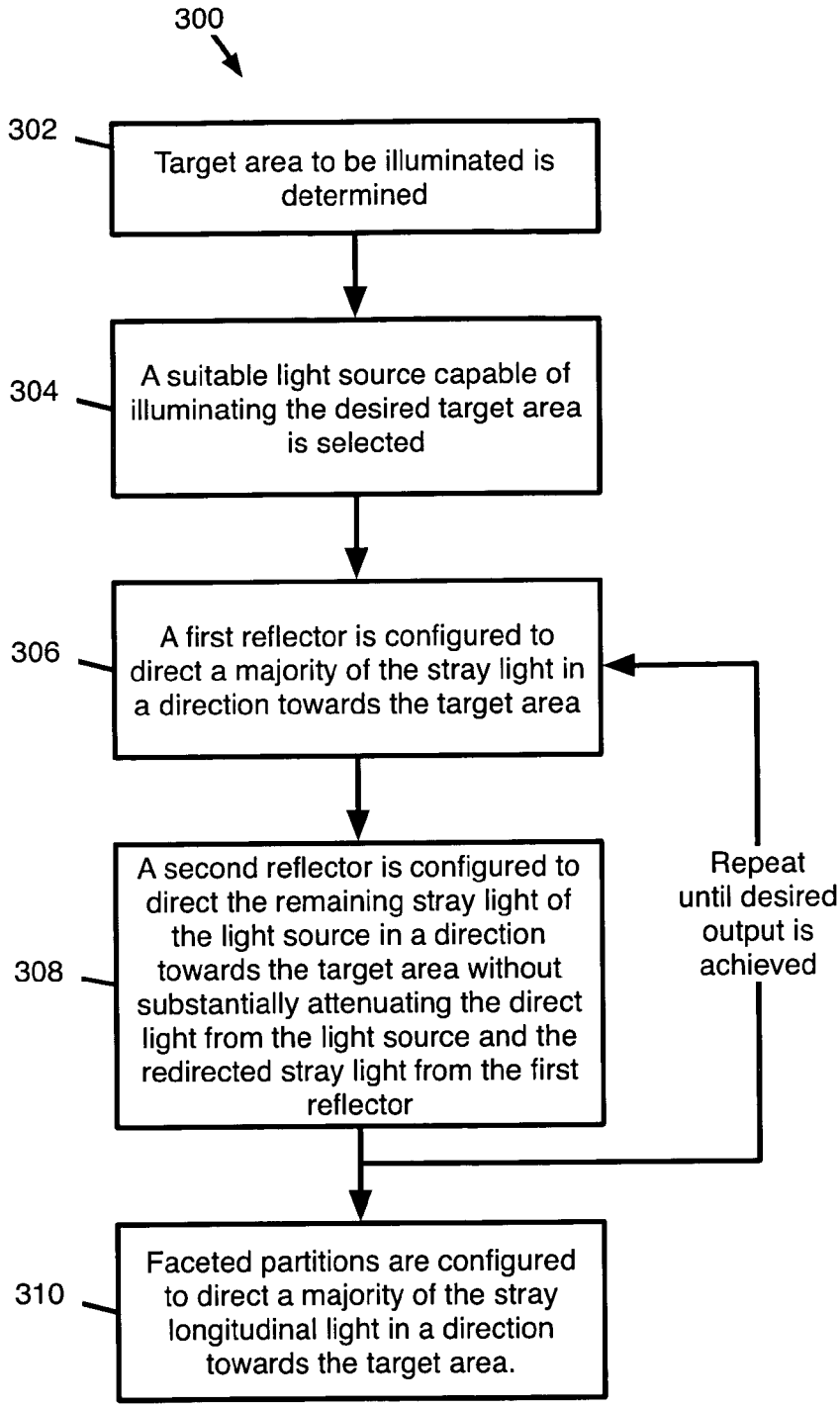
FIG. 30 is a method of designing a high efficiency light fixture, in accordance with one embodiment of the present invention.

FIG. 29 shows the derivation of the total power curve for a light fixture using the partitions described in FIGS. 28. Light from the central compartment 211 is limited by the edge rays 221 to produce the power curve 222. In a similar fashion, all of the other compartments produce identical power curves . . . i.e. curves 224 and 223 from compartments 220 and 218. For clarity, identical power curves from the two intermediate compartments are not shown. The addition of all five power curves produces the total power profile 225 of the light fixture. FIG. 30 is a method 300 of designing a high efficiency light fixture, in accordance with one embodiment of the present invention. The method 300 generally begins at block 302 where the desired target area to be illuminated by the light fixture is determined. The desired target area may, for example, be a work surface, a store aisle or entire room, where the rectangular design of FIG. 2, singularly or in arrays may be best suited, while the conical design of FIG. 3 might be a better choice for a particular exhibit in a store or museum.

In block 304, an extended light source capable of illuminating the desired target area is selected. The extended light source may, for example, be chosen singularly or from a combination of incandescent, fluorescent, LED light devices, and/or the like. Some considerations for selecting a light source include size of desired target area, height of light fixture relative to the target area, desired illumination level, and/or the like. The intensity of light emitted from the light source is typically substantially equal in all directions (although this is not a requirement), towards and away from the target area. The light traveling in directions towards the target area is generally referred to as direct light and the light traveling in directions away from the target area is generally referred to as stray light.

Once a light source is selected, the method continues to block 306 where an outer reflector is configured to direct a majority of the stray light in a direction towards the target area. This includes, for example, determining general size and shape of the outer reflector, and, more particularly, determining the number, size and angle of each individual facet of the outer reflector. The angle of the facet generally determines the location of the energy output within the target area and the size of the facet generally determines the amount of energy output. The configuration of each facet is typically designed to place all the reflected light in the target area, and, more particularly, specific regions of the target area so as to produce the desired output. Some factors that help determine the size and general shape of the outer reflector include the size and shape of the target area, the desired depth of the light fixture, the height of the light fixture relative to the target area, and/or the like. Some factors that help determine the facet configuration of the outer reflector include for example size of target area, distance to source, distance to target area, the desired placement of the light inside the target area, the amount of energy desired at specific locations within the target area, and/or the like. The outer reflector incorporates all mirrored surfaces on the inside and is arranged in such a way that only first reflections are implemented. That is, the source light only reflects off its mirrored surface one time before being directed to the target area.

In one embodiment, the facets closer to the light source have shorter lengths than the facets further from the light source near the open end of the outer reflector. This may be done to ensure that the reflected light stays within the target area. Because of this, however, the facets closer to the light source typically have a lower energy output than the facets further from the light source (e.g., larger the length the greater the energy output).

In another embodiment, the angles of facets closer to the light source are configured to aim the reflected light therefrom in combination near the center of the target area thereby increasing the energy at this point while the angles of the facets further from the light source, which have a higher energy output, are configured to aim the reflected light therefrom incrementally outward beyond the center thereby spreading the energy across the target area. In so doing, the illumination across the target area is more evenly distributed.

While this tends to provide a more uniform distribution of energy across the target area, it should be noted that this is not a limitation and that some designs may call for other non uniform distributions. In cases such as these, the various facets can be angled or lengthened in different ways to produce the desired output across the target area.

Thereafter, in block 308, a second reflector is configured to direct the remaining stray light of the light source in a direction towards the target area without substantially attenuating the direct light from the light source and the redirected stray light from the first reflector. This includes, for example, determining the general layout and position of the inner reflector, and more particularly, determining the number, size and angle of each individual facet of the inner reflector. The configuration of each facet is typically designed to capture all the remaining stray light and place it into the target area, while at the same time, slight adjustment of the angles allow many individual small portions of the direct source light and also small portions of the outer reflector beams to be placed on a specific region of the target area so as to help produce the desired output.

In one embodiment, in order to produce a light fixture with low depth, the inner reflector is positioned at the open end and within the outer reflector. Alternatively, a portion of the inner reflector may protrude out of the open end. This however, adds depth to the light fixture.

In another embodiment, the configuration of the inner reflector may be determined first by (referring to FIG. 20) dividing the angle between the outer reflector edge ray 108 and the desired limit 113 into a number of small sectors, so the individual internal reflectors are reduced in height, and thereby create less interference with the rays from the outer reflector. The individual angles and height can then be adjusted as necessary to achieve the optimum power plot, while maintaining no gaps between the reflectors at the reference rays 108 through 112. In most cases, the internal reflector includes mirrored surfaces over all of its reflecting surface area (front and back) and therefore the initial stray light is not absorbed or diffused but rather entirely reflected. Furthermore, the reflection of the stray light is accomplished without substantially attenuating the direct light from the light source or the reflected light from the first reflector. That is, the internal reflector allows the direct light from the source and the reflected light from the outer reflector to pass there through to the target area.

In some cases, the distribution of a portion of the reflected light from the outer reflector is moved by the inner reflector to specific regions of the target area, as for example regions of low light intensity. By controlling the distribution in this manner, the illumination of the target area can be made more uniform. By way of example, the inner reflector may include various facet arrangements for directing larger amounts of stray light to regions of the target area of low light intensity (e.g., outer regions of target area) and smaller amounts of stray light to regions of the target area with high light intensity (e.g., central region of target area). As should be appreciated, the illumination provided by the light source may vary from the center to edge of the target area, and the illumination provided by the outer reflector may not be enough to fully balance the illumination from center to edge of the target area.

One advantage of this method is that substantially all the light emitted from the light source is directed into the target area. Another advantage is that by controlling the reflections to specific areas, the illumination provided by the light fixture may be evenly distributed across the target area.

Since the internal reflectors are primarily designed for reduction of stray light, they have limited control of the total power curve. When the internal reflector has been designed to eliminate stray light as required, it may have altered the power curve of the outer reflector sufficiently so that the total light fixture power curve (FIG. 24) cannot be achieved. [For example, in the design illustrated, the inner facets shifted more of the outer reflector energy toward the center than the edges, causing the total to peak in the middle.] It is then necessary to go back to block 306 and modify the outer reflector design so that it provides appropriately corrected energy (reduced in the center as shown in FIG. 12), and then repeat block 308 to readjust the inner reflector for optimum results. Since blocks 306 and 308 are interacting, this process may have to be repeated several times in a critical application.

In embodiments that utilize partitions and particularly partitions that include facets, the method may include a subsequent block 310 where the faceted partitions are configured to direct a majority of the stray light traveling in the longitudinal direction (end to end rather than side to side) in a direction towards the target area. This includes, for example, determining the general layout, position and number of the faceted partitions, and more particularly, determining the number, size and angle of each individual facet of the faceted partition. The configuration of each facet is typically designed to capture the longitudinal stray light and place it into specific regions of the target area from one end to the opposite end, while at the same time, preventing distracting glares.

In one embodiment, the individual angles and heights of each facet are adjusted as necessary to achieve the optimum power plot from one end to the opposite end of the target area. In some cases, the facets can be designed to direct light to specific regions of the target area, as for example regions of low light intensity. By controlling the distribution in this manner, the illumination of the target area can be made more uniform. By way of example, the faceted partition may include various facets for directing larger amounts of stray light to regions of the target area of low light intensity and smaller amounts of stray light to regions of the target area with high light intensity. As should be appreciated, the illumination provided by the light source may vary from the end to end of the target area, and the illumination provided by the light source/outer reflector/inner reflector may not be enough to fully balance the illumination from end to end of the target area.

In one implementation, the facets are added at progressively lower angles and smaller heights down the inside of partitions (see for example FIG. 28A). This provides parallel rays. In another implementation, facets with the same angle and height are employed (see for example FIG. 28B). This provides rays that are spread out. These configurations illustrate that the facet angles and widths can be adjusted to achieve the most desirable longitudinal power curve in a manner similar to that used for adjusting the lateral power curve of the inner and outer reflectors.

It should be noted that a symmetrical reflector has been illustrated in the previous pages. However, an asymmetrical design can be created in the same manner, by substitution of the mirroring process with calculation of the facets on each side separately, but with summation of the power plots done in the same manner described.

It should also be noted that the number of facets is arbitrary. For example, a greater number of facets of narrower width may be used, provided the same design rules are followed.

It should further be noted that a curved reflector can be readily produced by simply connecting the junctions of a large number of smaller facets with a continuous curve. All of these smaller facets can be calculated and summed in the same manner just described. This design may be more pleasing aesthetically, although it may possibly reduce the performance.

Moreover, although the invention has been primarily shown and described with straight flat facets, it should be noted that this is not a limitation and that the facets may be embodied with a slight curve similar to slats in a Venetian blind. This may add rigidity to the facet thereby helping it remain in its desired position. Alternatively, they may be V-shaped rather than curved (e.g., essentially a facet pair) for the same reason.

Figure 31A:
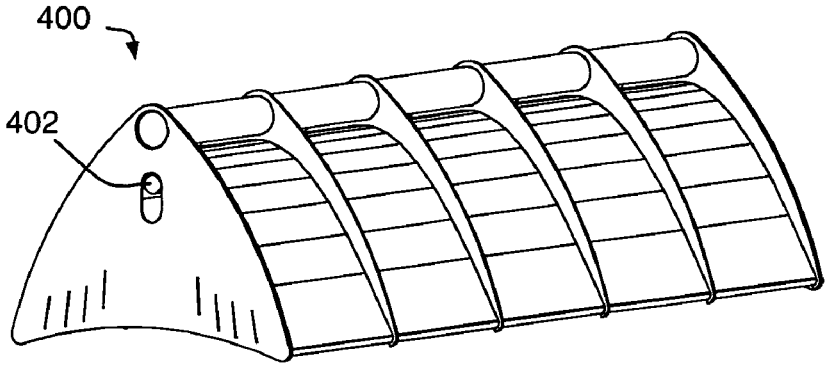
FIG. 31A is an assembled light fixture, in accordance with one embodiment of the present invention.
Figure 31B:
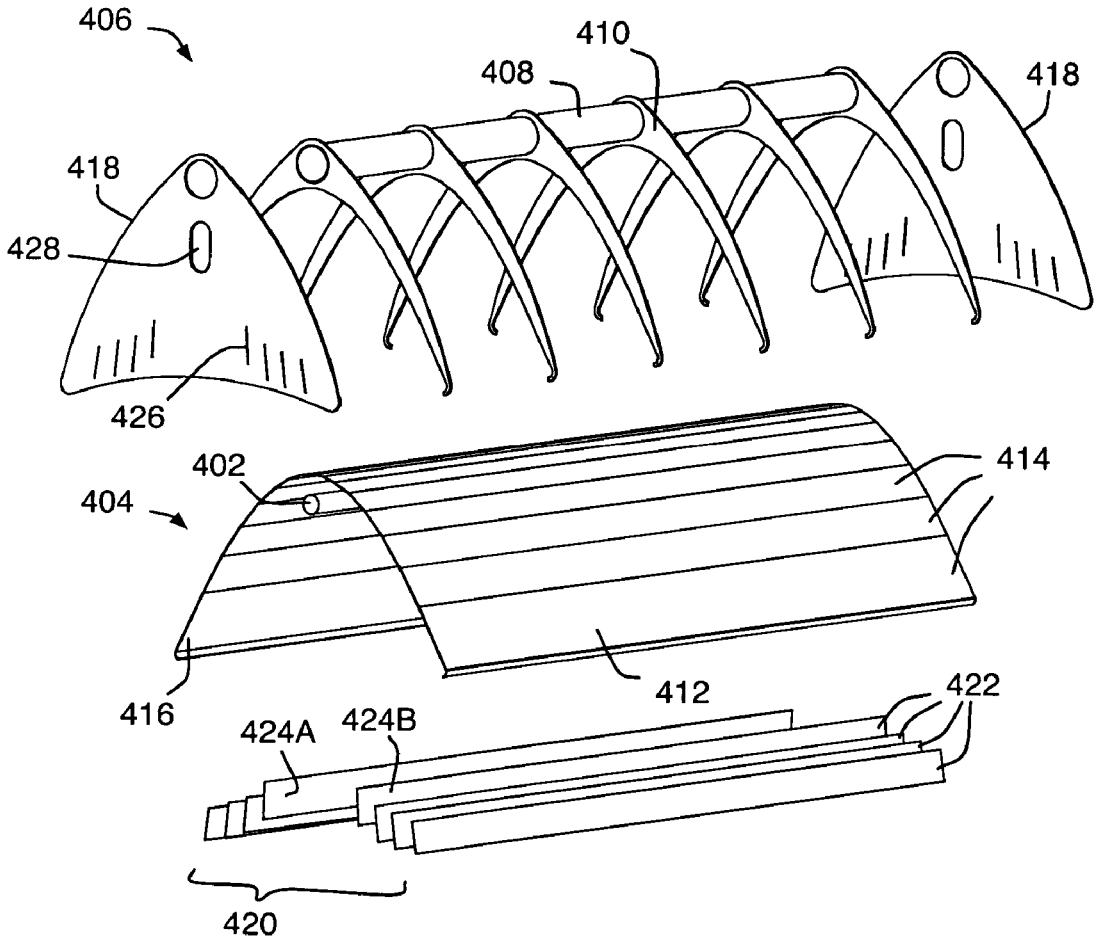
FIG. 31B is an exploded view, showing all the pieces that form the light fixture of FIG. 31A, in accordance with one embodiment of the present invention.

FIGS. 31A and B are diagrams of a light fixture 400, in accordance with one embodiment of the present invention. FIG. 31A shows the light fixture 400 in a final form and FIG. 31B is an exploded diagram showing all the pieces that form the light fixture 400. The light fixture 400 is made to agree with the previous descriptions as described in FIGS. 1 to 26.

As shown in both figures, the light fixture 400 includes an elongated extended light source 402 embodied in any length, a reflector assembly 404 for redirecting light emitted by the elongated light source 402 and a frame assembly 406 that structurally supports the reflector assembly 404.

The frame assembly 406 includes a spine tube 408 and a plurality of outer ribs 410 that accurately maintain the shape and position of the reflector assembly 404. In the illustrated embodiment, the inner periphery of the ribs 410 are shaped to match the outer periphery of the reflector assembly 404, i.e., dimensioned to fit around the reflector assembly 404. The ribs 410 are rigidly attached to the spine tube 408 so they are all in line and cannot rotate. The entire structure may be cast as one piece of metal or plastic, or separate parts that are attached to one another. Any suitable attachment means can be used. For example, the ribs 410 may be attached to the spine tube 408 by gluing, cementing, welding, press fitting, snapping, hot staking, or fastening with suitable hardware (e.g., screws, bolts, rivets, clips, etc.).

The reflector assembly 404 includes an outer reflector 412. The outer reflector 412 may be formed from sheet metal, molded plastic and/or the like. The outer reflector 412 may be formed in one piece or multiple pieces such as two halves split down the middle. In either case, the outer reflector 412 includes a plurality of parallel planar facets 414 that are connected at various angles to form the shape of the outer reflector 412. The facets 414 may be individual pieces that are attached together (e.g., welding) or they may be formed from an integral member as for example using a forming process such as bending or shaping. The edges such as the bottom edge of the outer reflector 412 may be rolled or reinforced to provide a more rigid structure.

In all of these implementations, the outer reflector 412 includes an inner reflective surface 416. The reflective surface 416 may be embodied as polished surfaces as for example the surfaces of a metal sheet reflector. The reflective surfaces may also be embodied as a reflective film that is attached to the non specular inner surface of any reflector. The reflective surface may also be formed using processes such as plating, metallization, deposition, or sputtering, and or the like. The outer reflector 412 may be attached to the frame assembly 406 using any suitable means including for example fastening hardware, cement, glue, snap fittings, etc. Alternatively, the outer reflector 412 and frame assembly 406 may be molded in one piece from plastic or other material.

The frame assembly 406 also includes a pair of end plates 418. The end plates 418 may be formed from sheet metals or molded plastics and may include an inside reflective surface similar to the outer reflector 412. The end plates 418 may be attached to the outer reflector 412 and frame assembly 406 using any suitable means including for example fastening hardware, cement, glue, snap fittings, etc. Alternatively, the end plates 418 and frame assembly 406 may be molded in one piece from plastic or other material.

The reflector assembly 404 also includes an inner reflector 420. The inner reflector 420 includes a plurality of parallel planar ribbons 422 that are spatially separated and set at various angles across the opening of the light fixture. The ribbons 422 may be formed from any suitable material including both rigid and flexible materials so long as they can maintain a planar form. By way of example, the ribbons 422 may be formed from sheet metal, plastics, films, etc. In all of these cases, both sides of the ribbons 422 include a reflective surface 424A and 424B, respectively. The reflective surfaces 424A and 424B may be formed from polished metal, reflective or mirrored films, metallization, and/or the like.

The ribbons 422 typically span the length of the outer reflector 412 and are typically attached to the end plates 418. The ribbons 422 may be attached to the end plates 418 using any suitable means including for example fastening hardware, cement, glue, snap fittings, etc. Additionally or alternatively, the ribbons 422 may be supported in slots 426 formed in the end plates 418 (as shown). By way of example, the slots 426 may be cut into the end plates 418 at the desired ribbon angle such that the ribbon ends can rest therein with or without attaching.

As shown in FIG. 31A, all the various parts are combined together to form a substantially rigid structure. In their combined form, the ribs 410 are attached to the spine tube 408, and the outer reflector 412 is attached to the ribs 410. Furthermore, the end plates 418 are attached at the ends of the outer reflector 412 and/or frame assembly 406, and the inner reflector 420 is supported by or attached to the end plates 418. As mentioned above, the various parts may be separate pieces that are assembled together and/or they may be integrally formed as for example via an injection molding process.

Any suitable elongated extended light source 402 may be used in the arrangement described above. The elongated extended light source 402 may for example be a fluorescent light tube. Alternatively, the elongated extended light source 402 may be an array of LED's, tungsten lamps, or neon tubes. In all of these cases, the elongated extended light source 402 is typically supported at their ends either directly or indirectly by the end plates 418. The end plates 418 may include a hole 428 for placement of the elongated light source 402 inside the outer reflector 412.

Although not shown, the light fixture 400, and any variations thereof as for example the light fixtures shown in the following FIGS. 32 through 36, may include one or two sockets 402 for powering and supporting the elongated light source, an electronic power supply that may be configured to fit within the spine tube 408, and end caps to cover the exposed tube sockets and inner reflector ends and/or mounting hardware.

One embodiment for producing the aforementioned light fixture will now be described. It should be noted that this embodiment is described by way of example and not by way of limitation as many methods may be implemented to produce the light fixture. In this embodiment, the outer reflector is divided into two equal parts, a first and second side. Each side is formed from an aluminum sheet with a polished inner surface. Furthermore, each facet is made via a bending process. During assembly, the two halves of the outer reflector are placed on a jig having a shape that coincides with the desired outer reflector shape. Thereafter, the two sides of the outer reflector are taped together such that the outer reflector drapes over the jig. In addition, the ribs, which include holes, are slid over the spine tube.

Thereafter, the frame assembly is placed over the outer reflector and the end plates are placed at the ends of the outer reflector. A second jig is used to locate the spine tube and ribs at their desired position relative to the outer reflector. Once the position is set, the various parts are glued together in a single step as for example using an epoxy thereby forming a rigid structure. Although only a single step is described, multiple gluing steps may be alternatively be used. For example, the ribs may be first glued to the spine tube and thereafter the frame assembly may be glued to the outer reflector and end plates. After the rigid structure is formed, flexible inner ribbons are slid through the slots in the end plate and held in tension with a spring means or other fastener.

Figure 32A:
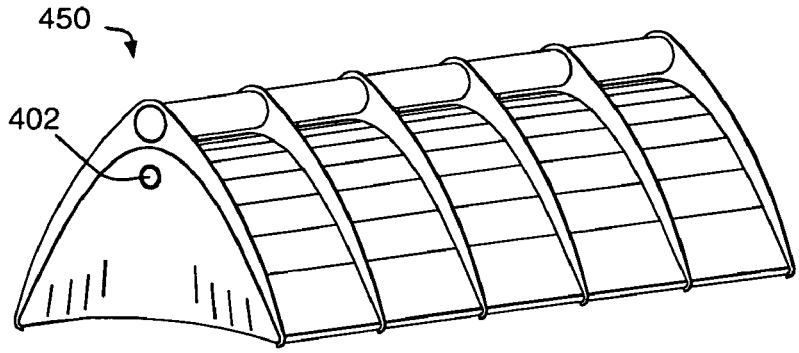
FIG. 32A is an assembled light fixture, in accordance with one embodiment of the present invention.
Figure 32B:
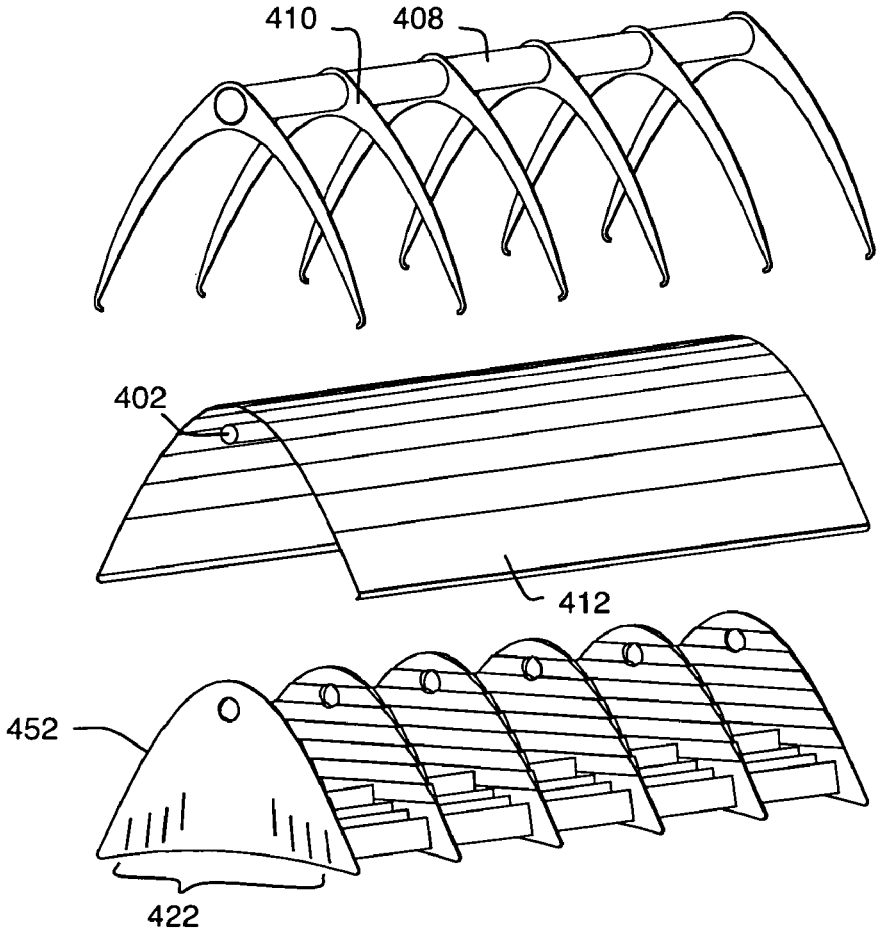
FIG. 32B is an exploded view, showing all the pieces that form the light fixture of FIG. 32A, in accordance with one embodiment of the present invention.

FIGS. 32A and 32B are diagrams of a light fixture 450, in accordance with one embodiment of the present invention.

FIG. 32A shows the light fixture 450 in a final form and FIG. 32B is an exploded diagram showing all the pieces that form the light fixture 450. The light fixture 450 of FIG. 32 is similar to the light fixture 400 described in FIG. 31 except that the end plates 418 are removed and a plurality of faceted partitions 452 are added. The outer perimeter edges of the partitions 452 have a shape that coincides with the interior perimeter shape of the outer reflector 412 and the inner perimeter edge of the ribs 410 have a shape that coincides with the exterior perimeter shape of the outer reflector 412. That is, the edges of the partitions 452 and ribs 410 are shaped to match the facets of the outer reflector 412. When assembled, the outer reflector 412 is sandwiched between the inner partitions 452 and the outer ribs 410 such that the facet angles of the outer reflector 412 are accurately maintained.

The sandwich may be assembled using any suitable means including for example fastening hardware, cement, glue, snap fittings, etc. In one example, the partitions 452 include sockets or tabs on their outer edge that extend or project through openings in the outer reflector 412 and that mate with corresponding lugs on the ribs 410. Thus, the outer reflector 412 is squeezed between the partitions 452 and the ribs 410 via a tightening action (e.g., fastener, cam, lever, etc.).

The faceted partitions 452 serve various functions including but not limited to redirecting the light along the longitudinal axis of the luminaire in order to reduce end stray light, accurately supporting the inner reflectors 422 in their desired orientation across the length of the light fixture 450, i.e., maintain their desired angle and flatness, etc.

Figure 33A:
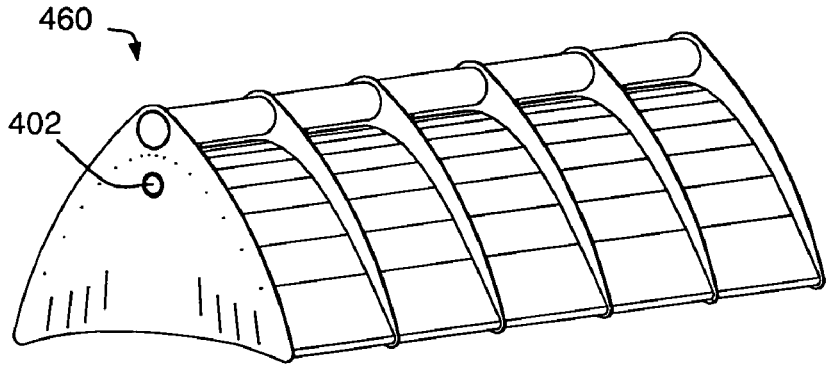
FIG. 33A is an assembled light fixture, in accordance with one embodiment of the present invention.
Figure 33B:
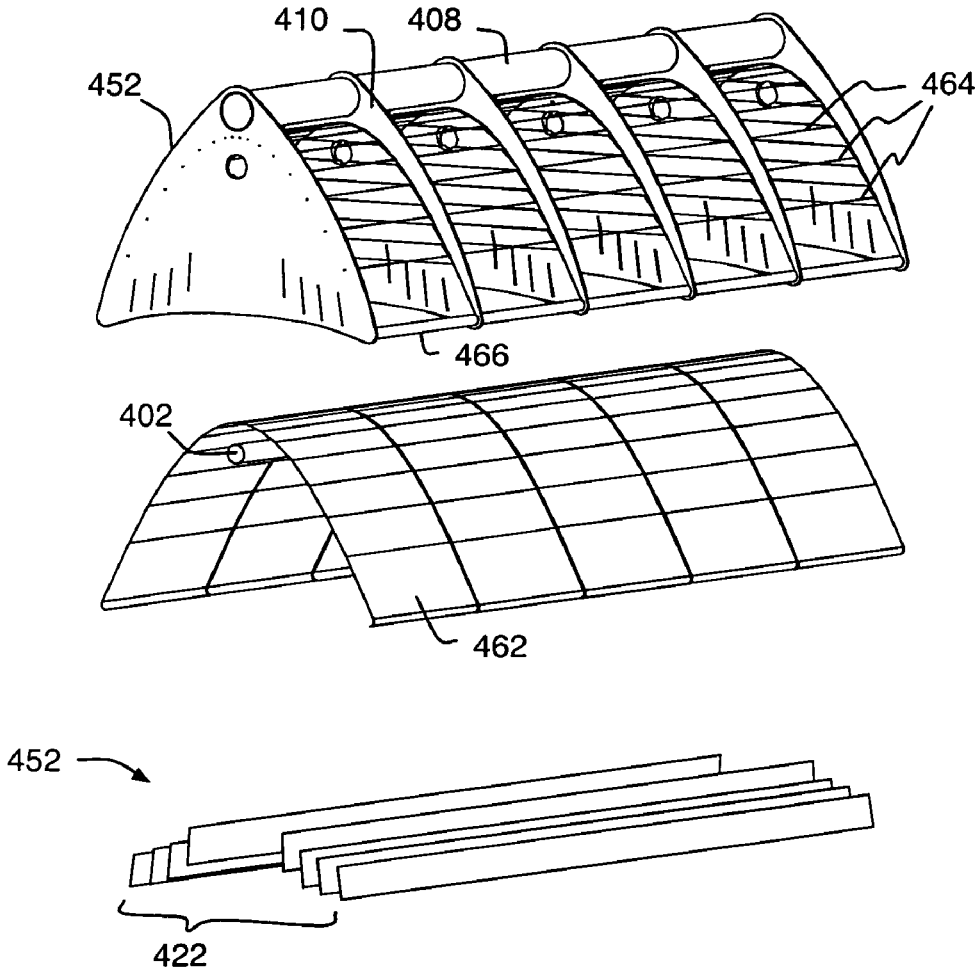
FIG. 33B is an exploded view, showing all the pieces that form the light fixture of FIG. 33A, in accordance with one embodiment of the present invention.

FIGS. 33A and 33B are diagrams of a light fixture 460, in accordance with one embodiment of the present invention. FIG. 33A shows the light fixture 460 in a final form and FIG. 33B is an exploded diagram showing all the pieces that form the light fixture 460. The light fixture 460 is similar to the light fixture 450 described in FIG. 32 except that the ribs 410 and partitions 452 are combined as one piece element. Furthermore, instead of using a rigid outer reflector, a flexible outer reflector 462 is used. In this embodiment, the flexible outer reflector 462 is supported by wires or rods 464 that span the length of the light fixture 460 and that are attached to the end partitions 452. In the case of wires, the wires may be held in tension between the end partitions 452. In the case of rods, the rods may be inserted through holes in the partitions 452. The wires or rods 464 are positioned at the apex of each of the facets around the end partitions 452, and separate flexible outer reflectors 462 are draped or stretched between the partitions and over the wires or rods 464, thereby forming planar facets between the apex lines. In this configuration, the flexible outer reflectors 462 may be embodied as sheets of Mylar film with a reflective surface on its interior surface, by way of example.

In some cases, tubes or rods 466 may be used at the bottom corners of each rib partition combination to increase the rigidity and strength of the structure (a stiffener). The tubes 466 also provide a structure for anchoring the flexible outer reflectors 462. In some cases, a tensioning device may be provided between the flexible outer reflector 462 and the tube 466 to keep the flexible outer reflector 462 tight over the support wires/rods 464 (e.g., spring loaded device that uses spring tension to exert a force at the ends of the flexible outer reflector). In one example, the tensioning device may be similar to those used in a roller window shade with a tube and shade wrapped around it.

Figure 34:
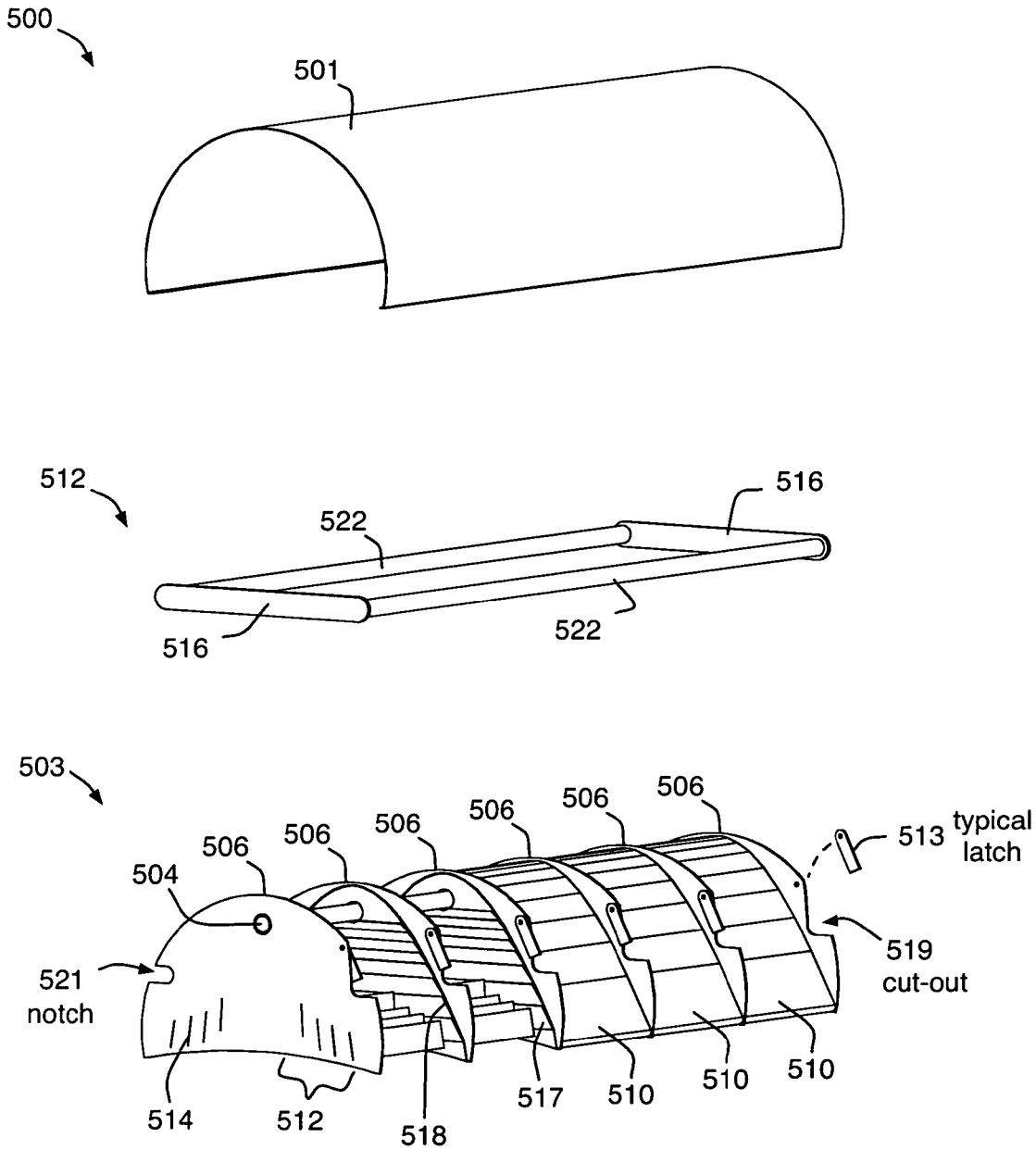
FIG. 34 is a partially exploded view of a light fixture, in accordance with one embodiment of the present invention.

FIG. 34 is a diagram of a light fixture 500, in accordance with one embodiment of the present invention. The light fixture 500 includes a cosmetic shell 501 positioned over a light assembly 503. The cosmetic shell 501 may be plastic (possibly a flexible or vacuum formed sheet) or thin metal such as aluminum, etc. The cosmetic shell 501 provides a clean continuous appearance at the outer surfaces of the light fixture 500.

The light assembly 503 includes a plurality of faceted partitions 506 similar to those of FIGS. 32 and 33, except their outer edge matches the inner shape of the cosmetic shield 501, or alternatively that forms the shape of the cosmetic shield 501 as for example in the case of a flexible sheet. As illustrated, the individual reflectors 510 are identical in cross-section to the reflector of FIG. 31, and the separate sections are held in place by matching grooves 518 on the inside faces of the partitions 506. The partitions are mirrored, faceted and grooved on both sides for the center partitions, and a single side for the end partitions.

The partitions 506 can for, example, be made as an injected molded plastic part or possibly formed from sheet metal. Furthermore, the reflective surfaces of each of the facets 517 may be applied via a plating process (e.g., chrome), metallization (e.g., aluminum), or by adhering a reflective film or metal to each of the facets 517.

The light assembly 503 also includes a plurality of inner reflectors 512 positioned in slots 514 in each partition, similar to those mentioned previously in FIGS. 32 and 33.

A chassis frame 512 holds the assembly 503 of external reflectors 510, internal reflectors 512, and partitions 506 together. The frame 512 consists of tubes 522 and end bars 516 formed into a light weight one piece chassis by epoxy, welding or others means to prevent twisting. For assembly, one tube 522 is inserted in the notches 521 along one side of the partitions 506. Then the other tube 522 of the frame is lowered into the cutouts 519 on the opposite side of the partitions 506, and locked in place with the latches 513. The tubes 522 are made the proper length so the end bars 516 will be a snug fit over the stack of partitions 506 and reflectors 510, and no hardware is required. Thus the luminaire is easily assembled by a novice, and could readily be supplied in kit form.

Figure 35:
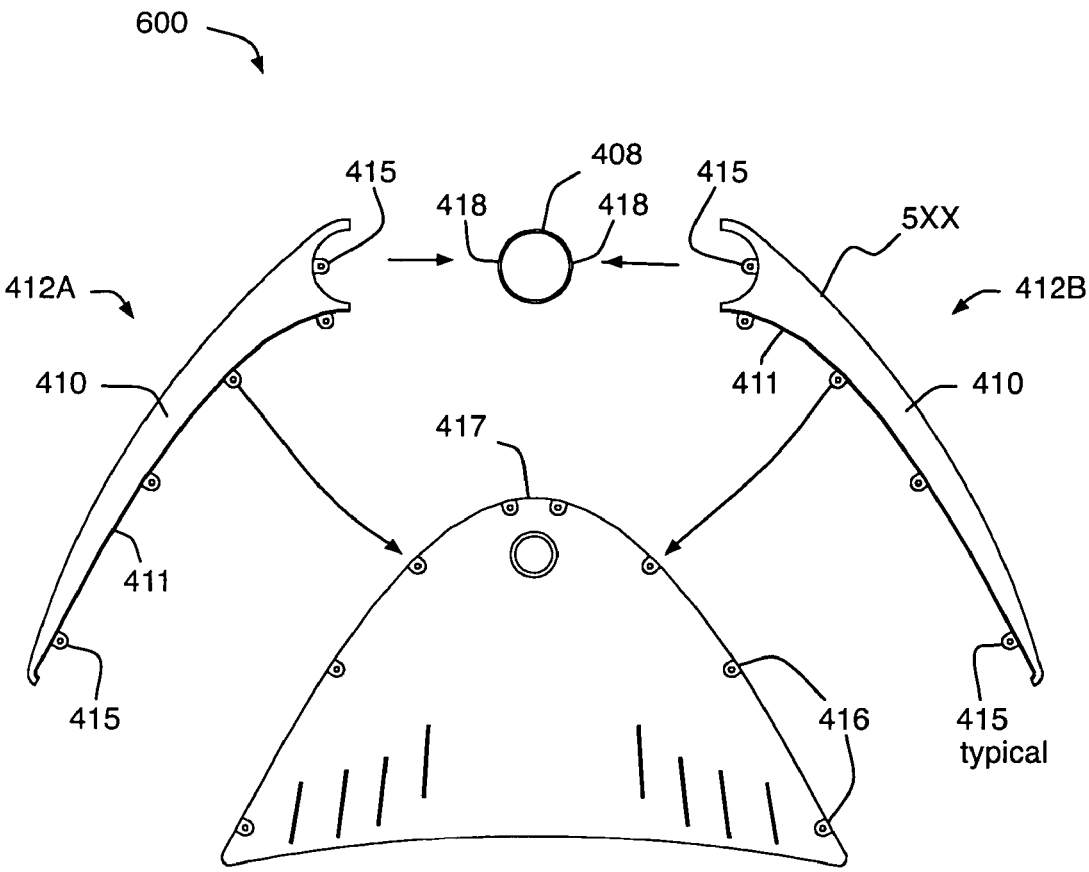
FIG. 35 is an exploded cross-section view of the major pieces that form a kit form of a light fixture, in accordance with one embodiment of the present invention.

FIG. 35 is an exploded view of a light fixture 600, in accordance with one embodiment of the present invention. The light fixture 600 may correspond to any of FIGS. 31 through 33. In this embodiment, many parts of the light fixture 600 are broken into smaller components in order to reduce shipping costs and make assembly easier. As should be appreciated, if the parts are too large, the parts may have to be shipped in large unwieldy boxes or crates, which can be very expensive to ship. Furthermore, large parts can be hard to manage for some end users (e.g., do it yourselfers). By configuring the parts to fit into a standard shipping box, shipping costs can be drastically reduced and the parts can be made easier to handle. In order to accomplish this, the size and dimension of each part should be less than the largest dimension (length, width, height) of the standard shipping box. By way of example, a standard shipping box may have the following dimensions: (height+width) X2+length=108 inches. In some cases, the parts may further be designed so that they can be nested with each other, thereby saving more space.

The light fixture 600 includes components described in greater detail in FIGS. 31 through 33. In this embodiment, however, the larger components utilize multiple segments that are coupled together to form the final component. As shown in FIG. 35, the outer reflector 411 is divided in two halves 412A and 412B as clam shell assemblies made from the reflectors 411 with rib halves 410 attached. The two reflector assemblies 412A and B are attached to the spine tube 408 by inserting all of the rib tabs 415 into slots 418 in the tube 408 and pushing a rod through the holes, to lock the ribs in place and to provide a rigid outer reflector and spine tube assembly.

Referring to FIG. 35, the partitions 417 may be attached to the rib and spine assembly in a similar manner, by fitting the partition sockets 416 over the appropriate rib tabs 415. When all are in place, the outer reflector 411 is sandwiched between the partitions 417 and ribs 410. The rods may then be pushed through all the holes to lock the assembly together into a strong twist-free structure.

Alternately, the various parts of the light fixture may be secured to each other using a variety of techniques including for example welds, glue, fasteners, fittings, and/or the like. In most cases, the interface between parts includes tabs or other protrusions that are inserted into corresponding slots or other voids in order to align the parts as well as provide strength to the overall structure. In some cases, the tabs are fixed in the slots using a suitable attachment means including for example screws, bolts, snaps, glue, rods, pins, etc. In another implementation that can be assembled without using tools, snap fittings are used instead of rods so the luminaire tabs can be snapped into corresponding slots. In other cases, the tabs may not be fixed to the slots at all (e.g., other attachment means may be used to secure the parts together).

In another embodiment, described by way of example and not by way of limitation, the light fixture is packaged for shipment with the rib tabs 415 installed through the openings in the outer reflectors 411, and each assembly 412 is taped to an outer foam shipping shell to hold it together. Then, with one side lying flat, face up, the spine tube 408 is installed, with its slots 418 on one side pushed over the rib tabs 415 and locked in place with a rod pushed one at a time though each of the holes. Thereafter, starting at one end, the sockets 416 of one partition 417 are pushed onto the vertical rib tabs 415 of the horizontal reflector assembly 412 and held in place with several rods inserted just far enough to make room for the next partition. This process is repeated until all partitions are in place, then the missing rods are inserted. The second reflector assembly 412 may now be positioned on top and adjusted until all rib tabs 415 are properly seated in the appropriate sockets 416 of all partitions 417, and the slots 418 in the tube 408. The remaining rods are then inserted.

Finally, the inner reflectors and elongated light source can be inserted through the corresponding slots/holes in the end plates and partitions, and the foam shipping shells can be removed. With the ribs keyed into the spine tube and partitions, the structure is strong and resistant to twisting. This technique would dramatically reduce the cost of factory assembly and shipping. Additional cost reduction may be achieved by fabricating or molding the half rib and half reflector as one element.

Figure 36:
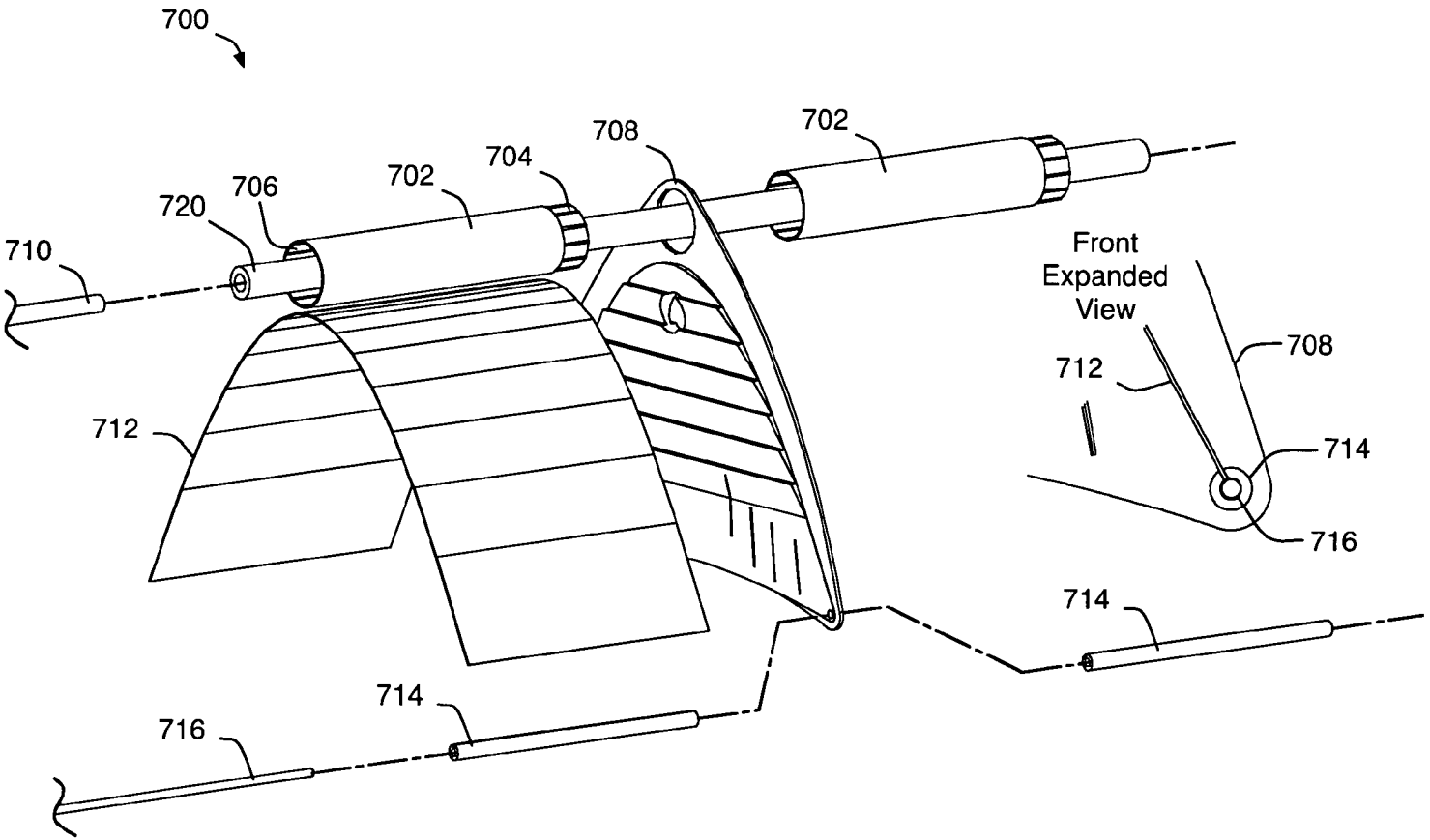
FIG. 36 is an exploded view of another kit form of a light fixture, in accordance with one embodiment of the present invention.

FIG. 36 is an exploded view of another light fixture 700, which may be shipped in kit form, in accordance with one embodiment of the present invention. The light fixture 700 may correspond to any of FIGS. 31 through 33. This design has the advantage of modular assembly to any length from just three basic parts (and thus a considerable reduction in tooling costs). They are the molded partitions 708 and tubes 702, and the reflector 712 which may also be molded or alternately formed from sheet metal, with a mirrored inside surface (described in previous versions). The tubes 702 have mating male/female interlocking features on opposite ends, such as splines or keyways. And the mounting hole in the partition 708 is made with similar interlocking features to prevent rotation. The reflector sections 712 are captured between the partitions 708 in the grooves of partitions 708, as described previously in FIG. 34. The one piece tube 720 is inserted through the full length of the assembled components of fixture 700, to provide a rigid spine similar to previous embodiments, and the threaded rod 710 holds the assembly together (The tube 720 is a snug fit inside the interlocking tubes 702, but is shown reduced in diameter for clarity). The slotted tubes 714 and threaded rods 716 hold the bottom corners of the light fixture 700 together and reinforce the exposed edges of the reflectors 712. The inner reflectors, lamp and sockets, power supply and cosmetic end caps are not shown, but are similar to those described previously.

While this invention has been described in terms of several preferred embodiments, there are alterations, permutations, and equivalents, which fall within the scope of this invention. For example, although the outer reflector has been primarily shown and described with connected segments (e.g. facets), it should be appreciated that the outer reflector may also be formed from a collection of non-connected segments overlapping in such a way as to avoid any light leakage. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

What is claimed is:

1. A light fixture for illuminating a specific target area, the light fixture comprising:

an extended light source that emits light from a surface, the light source emitting light from the surface in directions towards the target area and away from the target area; and a reflector arrangement configured to redirect the light that would otherwise be emitted from the surface of the light source in directions away from the target area to directions towards the target area such that substantially all the light emitted from the light source is made incident in or directed into the target area wherein the reflector arrangement further includes:

an outer reflector having a reflective surface that partially surrounds the light source, the reflective surface being configured to reflect therefrom all light incident thereon to the target area; and an inner reflector disposed inside an outer reflector and having dual reflective surfaces, the reflective surfaces being configured to reflect therefrom all light incident thereon to the target area.

2. The light fixture as recited in claim 1 wherein the reflector arrangement redirects the light in a manner that makes the light intensity substantially uniform over the entire target area.

3. The light fixture as recited in claim 1 wherein the light fixture extends longitudinally and further comprising one or more partitions disposed longitudinally within the light fixture.

4. The light fixture as recited in claim 3 wherein the one or more partitions include mirrored facets.

5. The light fixture as recited in claim 1 wherein the reflector arrangement includes the outer reflector configured to capture and redirect a majority of stray light emitted from the light source to the target area, and the inner reflector configured to capture and redirect the remaining stray light emitted from the light source to the target area.

6. A light fixture for illuminating a specific target area, the light fixture comprising:

an extended light source that emits light from a surface, the light source emitting light from the surface in directions towards the target area and away from the target area; and a reflector arrangement configured to redirect the light that would otherwise be emitted from the surface of the light source in directions away from the target area to directions towards the target area such that substantially all the light emitted from the light source is made incident in or directed into the target area, wherein the reflector arrangement comprises:

an arcuate outer reflector having a plurality of straight flat minored outer facets positioned in succession from a center to an edge of the arcuate outer reflector, the configuration of each of the straight flat mirrored outer facets being configured to direct light of varying proportions to different regions of the target area; and an inner reflector disposed within an open end of the arcuate outer reflector, the inner reflector having a plurality of straight flat inner facets positioned on each side of a vertical axis of the light fixture, each of the straight flat inner facets having mirrored surfaces on opposing sides of the straight flat inner facets, the configuration of each of the straight flat inner facets being configured to direct light of varying proportions to different regions of the target area.

7. The light fixture as recited in claim 6 wherein the reflector arrangement redirects the light in a manner that makes the light intensity substantially uniform over the entire target area.

8. The light fixture as recited in claim 6 wherein the reflector arrangement includes the outer reflector configured to capture and redirect a majority of stray light emitted from the light source to the target area, and the inner reflector configured to capture and redirect the remaining stray light emitted from the light source to the target area.

9. The light fixture as recited in claim 6 wherein the light fixture extends longitudinally and further comprising one or more partitions disposed longitudinally within the light fixture, wherein the one or more partitions include mirrored facets.

10. A method of designing a high efficiency light fixture, the method comprising:

determining the desired target area where light is to be distributed;

selecting a light source capable of illuminating the desired target area;

configuring an outer reflector to reflect all light incident thereon to the desired target area, the outer reflector partially surrounding the light source and defining an open end where both light emitted from the light source and light reflected from the outer reflector travels out of the light fixture, the outer reflector capturing a majority of stray light that would otherwise travel through the open end of the outer reflector in a direction outside the target area and redirecting it to the target area; and configuring an inner reflector to reflect all light incident thereon to the desired target area while still substantially allowing direct light emitted from the light source in a direction towards the target area and light reflected from the outer reflector to reach the target area, the inner reflector being positioned at the open end of the outer reflector, the inner reflector capturing the remaining portions of stray light that would otherwise travel through the open end of the outer reflector in a direction outside the target area and redirecting it to the target area.

11. The method as recited in claim 10 wherein configuring the outer reflector includes adjusting the length and angle of facets of the outer reflector so as to selectively direct the light within the target area.

12. The method as recited in claim 10 further comprising configuring partitions to reflect light incident thereon to the desired target area, the partitions being positioned at least at the ends of the outer reflector, the partitions capturing stray light that would otherwise travel past the ends of the outer reflector in a direction outside the target area and redirecting it to the target area.

13. The method as recited in claim 12 wherein configuring the partitions includes adjusting the placement, length and angle of facets of the partitions so as to selectively direct the light within the target area.

14. The method as recited in claim 10 wherein configuring the inner reflector includes adjusting the placement, length and angle of facets of the inner reflector so as to selectively direct the light within the target area.

15. A method of illuminating a specific target area, the method comprising:

emitting light from a surface of a light source, the light emanating in directions towards the target area and away from the target area;

reflecting at least a first portion of the light emanating in directions away from the target area to the target area, all of the first portion of light being made incident within the target area; and reflecting at least a second portion of the light emanating in direction away from the target area to the target area, all of the second portion of light being made incident within the target area, wherein substantially all the light emitted from the light source is directed into the target area due to the reflections.

16. The method as recited in claim 15 wherein he first and second portions are reflected in such a way as to evenly distribute light across the target area.

17. A light fixture, comprising:

a lamp that emits light from a surface; and a reflector arrangement that uniformly concentrates all the light emitted from the surface of the lamp to a target area, the reflector arrangement comprising:

an outer reflector partially surrounding the lamp and defining an open end through which light emitted from the surface of the lamp and light reflected from the outer reflector travel out of the light fixture, the outer reflector including a plurality of interconnected outer facets positioned in an arcuate manner such that the outer reflector flares outwardly from its center to its open end, each of the outer facets having a flat mirrored surface that faces the lamp and that reflects all light incident thereon to the target area; and an inner reflector positioned at the open end of the outer reflector, the inner reflector capturing stray light that is traveling in a direction away from the target area and redirecting the stray light to the target area, the inner reflector including a plurality of spaced apart and laterally positioned inner facets, each of the inner facets having flat mirrored surfaces on both of its sides that reflect all light incident thereon to the target area.

18. The light fixture as recited in claim 17 wherein the angles of the outer facets are determined in such a way so as to selectively direct the light within the target area.

19. The light fixture as recited in claim 18 wherein the angle of each individual outer facet relative to the horizontal becomes steeper from the center to open end of the outer reflector.

20. The light fixture as recited in claim 17 wherein the length of the outer facets are determined in such a way so as to effect the light output in different regions of the target area.

21. The light fixture as recited in claim 17 wherein the length of each individual facet becomes larger from the center to the open end of the outer reflector.

22. The light fixture as recited in claim 17 wherein the reflector arrangement has a central vertical axis and wherein the reflector arrangement is symmetric on both sides of central vertical axis.

23. The light fixture as recited in claim 17 wherein the outer reflector includes a central outer facet located at the center of the outer reflector and eight angled outer facets that flare outwardly on each side of the central outer facet.

24. The light fixture as recited in claim 17 wherein the angles of the inner facets are determined in such a way so as to selectively direct the light within the target area.

25. The light fixture as recited in claim 17 wherein the angle of the inner facets become steeper from the edge to the center of the light fixture.

26. The light fixture as recited in claim 17 wherein the light fixture is an elongated light fixture, the lamp and reflector arrangement extending longitudinally in parallel from one end to the other end of the light fixture.

27. The light fixture as recited in claim 17 wherein the lamp is a bulb and the outer reflector is domed shaped.

28. The light fixture as recited in claim 17 wherein the inner reflector is disposed entirely within the outer reflector.

29. The light fixture as recited in claim 17 wherein the position, length and angle of the outer most inner facet are configured to block stray light from leaking past the edge.

30. The light fixture as recited in claim 17 wherein the top edge of the most peripheral inner facet prevents stray light from leaking past the edge of the outer reflector, wherein the bottom edge of the most peripheral inner facet prevents stray light from leaking over the top edge of the next peripheral inner facet.

31. The light fixture as recited in claim 30 wherein the top edge of the next peripheral inner facet in the succession of inner facets prevents stray light from leaking past the bottom edge of the most peripheral inner facet, wherein the bottom edge prevents stray light from leaking over the top edge of the next peripheral inner facet.

32. The light fixture as recited in claim 17 wherein the light fixture extends longitudinally and further comprising a plurality of partitions disposed longitudinally within the light fixture, the plurality of partitions including at least two end partitions placed at the ends of the outer reflector, and one middle partition placed between the end partitions, the partitions helping support the inner facets in their desired position relative to the lamp and outer reflector.

33. The light fixture as recited in claim 32 wherein the inside surface of the end partitions and both surfaces of the middle partitions include a plurality of partition facets, the partitions facets having flat mirrored surfaces that reflect light incident thereon to the target area.

34. The light fixture as recited in claim 32 wherein the angles of the partition facets are determined in such a way so as to selectively direct the light within the target area.

35. The light fixture as recited in claim 32 wherein the angle and height of the partition facets change from the top to bottom of the partition.

36. The light fixture as recited in claim 32 wherein the angle and height of the partition facets are identical.

37. The light fixture as recited in claim 17 further comprising a frame assembly that structurally supports the reflector arrangement.

38. The light fixture as recited in claim 37 wherein at least a portion of the various components of the light fixture are segmented into smaller components to reduce shipping costs and make assembly easier.

39. The light fixture as recited in claim 37 wherein the frame assembly comprises:

a longitudinal spine tube; and a plurality of outer ribs connected to the spine tube at longitudinal increments along the spine tube, the inner perimeter of the outer ribs having a shape that matches the outer perimeter of the outer reflector of the reflector arrangement, the outer ribs being configured for attachment to the outer reflector of the reflector arrangement.

40. The light fixture as recited in claim 39 wherein the outer reflector is divided into a first half and a second half, the outer ribs are divided into a first and second half, the first half of the outer ribs being attached to the first half of the outer reflector thereby forming a first reflector unit, the second half of the outer ribs being attached to the second half of the outer reflector thereby forming a second reflector unit, the first and second reflector units being configured for separate attachment to the spine tube.

41. The light fixture as recited in claim 39 wherein the outer reflector is segmented into multiple components, the outer ribs are segmented into multiple components and the spine tube is segmented into multiple components, each of the segmented components including an interlocking feature for attaching the light fixture together.

42. The light fixture as recited in claim 39 wherein the frame assembly further comprising a pair of end plates that close the ends of the outer reflector and help structural support the reflector arrangement.

43. The light fixture as recited in claim 42 wherein the end plates include slots that support the ends of the inner facets of the inner reflector and hold the inner facets in their desired position relative to the outer reflector and lamp.

44. The light fixture as recited in claim 17 wherein the outer reflector is formed from a flexible material, and wherein the flexible outer reflector is supported by longitudinally extending members that span the length of the light fixture between its ends, the longitudinally extending members being positioned at the apex of each of the outer facets, the flexible outer reflector being draped over the longitudinally extending members thereby forming the outer facets of the outer reflector, the longitudinally extending members being selected from wires or rods, the flexible outer reflector having a reflective surface on its interior side.

45. The light fixture as recited in claim 17 wherein the lamp is a fluorescent tube.

* * * * *